US006316177B1

(12) United States Patent
Allway et al.

(10) Patent No.: US 6,316,177 B1
(45) Date of Patent: Nov. 13, 2001

(54) COLOR PHOTOGRAPHIC ELEMENT CONTAINING SPEED-IMPROVING POLYMERS

(75) Inventors: Philip A. Allway, Herts (GB); Tienteh Chen, Penfield, NY (US); David S. Ross, Rochester, NY (US); Stephen P. Singer, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/540,808

(22) Filed: Mar. 31, 2000

(51) Int. Cl.[7] ..... G03C 1/08; G03C 7/26; G03C 7/32

(52) U.S. Cl. ..... 430/550; 430/551; 430/599; 430/600; 430/607; 430/613; 430/614; 430/615; 430/627; 430/630

(58) Field of Search ..... 430/550, 551, 430/599, 600, 607, 613, 614, 615, 627, 630

(56) References Cited

U.S. PATENT DOCUMENTS

| | | | | |
|---|---|---|---|---|
| 3,576,638 | | 4/1971 | Tuites et al. . | |
| 3,598,600 | | 8/1971 | Tuites et al. . | |
| 3,753,956 | | 8/1973 | Tuites et al. . | |
| 3,779,769 | | 12/1973 | Abel . | |
| 4,414,305 | * | 11/1983 | Nakamura et al. | 430/373 |
| 4,528,264 | | 7/1985 | Ishiguro et al. . | |
| 4,728,601 | | 3/1988 | Rowland et al. . | |
| 5,032,494 | * | 7/1991 | Kurematsu et al. | 430/375 |
| 5,192,647 | * | 3/1993 | Kojima et al. | 430/607 |
| 5,213,959 | | 5/1993 | Saitou et al. . | |
| 5,229,249 | | 7/1993 | Katoh et al. . | |
| 5,275,931 | | 1/1994 | Saitou et al. . | |
| 5,702,877 | | 12/1997 | Odenwalder et al. . | |
| 5,916,742 | * | 2/2001 | Ikari et al. | 430/615 |
| 6,043,013 | * | 3/2000 | Burns et al. | 430/507 |
| 6,054,257 | * | 4/2000 | Boff et al. | 430/505 |
| 6,140,029 | * | 10/2000 | Clark et al. | 430/614 |
| 6,190,848 | * | 2/2001 | Boff et al. | 430/607 |
| 6,190,849 | * | 2/2001 | Burns et al. | 430/607 |

FOREIGN PATENT DOCUMENTS

| | | |
|---|---|---|
| 0 574 331 A2 | 12/1993 | (EP) . |
| 64-019343 | 1/1989 | (JP) . |
| 1-097946 | 4/1989 | (JP) . |
| 4-107446 | 4/1992 | (JP) . |
| 6-059363 | 3/1994 | (JP) . |
| 8-262601 | 10/1996 | (JP) . |

OTHER PUBLICATIONS

The Theory of the Photographic Process, T.H. James, Ed., 4th Edition, Macmillan Publishing Co, NY, Chapter 13, Section J.

* cited by examiner

*Primary Examiner*—Geraldine Letscher
(74) *Attorney, Agent, or Firm*—Arthur E. Kluegel

(57) ABSTRACT

Disclosed is a color silver halide photographic element comprising a light-sensitive silver halide emulsion layer or a non-silver containing light-insensitive layer, said light-sensitive or light-insensitive layer containing a polymer compound comprising a heterocycle unit derived from:

(a) a heterocycle monomer (1) comprising two or more annulated rings containing, in total, a minimum of three ring heteroatoms of which no more than two of the heteroatoms are connected in sequence to each other and (2) having a ClogP less than 6.2; or (b) a monocyclic heterocycle monomer having exactly three ring heteroatoms and having a ClogP less than 8.75;

with the proviso that the heterocycle unit does not contain a hydroxy or mercapto group (or their tautomeric equivalent), and does not react with oxidized developer; and the amount of the polymer compound in the element being sufficient to increase the photographic speed of the element compared to the same element without the compound.

59 Claims, No Drawings

COLOR PHOTOGRAPHIC ELEMENT CONTAINING SPEED-IMPROVING POLYMERS

FIELD OF THE INVENTION

This invention relates to a color photographic element comprising, in a layer containing a light-sensitive silver halide emulsion layer or in a non-silver containing light-insensitive layer, a speed-improving polymer containing a heterocycle unit derived from a monomer having a heterocycle comprising at least three ring heteroatoms.

BACKGROUND OF THE INVENTION

It is a long-standing objective of color photographic origination materials to maximize the overall response to light while maintaining the lowest possible granularity. Increased photographic sensitivity to light (commonly referred to as photographic speed) allows for improved images captured under low light conditions or improved details in the shadowed regions of the image. In general, the overall light sensitivity provided by the light-sensitive silver halide emulsions in such systems is determined by the size of the emulsion grains. Larger emulsion grains capture more light. Upon development, the captured light is ultimately converted into dye deposits which constitute the reproduced image. However, the granularity exhibited by these dye deposits is directly proportional to the grain size of the silver halide emulsion. Thus, larger silver halide emulsion grains have higher sensitivity to light but also lead to higher granularity in the reproduced image. Therefore, it is a fundamental problem in photography to improve the light sensitivity of a silver halide element without a corresponding increase in another property such as granularity. In this description, it will be understood that the demonstrated increase in sensitivity is accomplished without a significant sacrifice in granularity. Stated from another perspective, it has been a long-standing problem to provide materials which maximize the response to light of a silver halide emulsion for any given grain size.

For example, it is well known that highly reactive couplers or couplers that form dyes with high extinction coefficients can maximize the response of silver halide emulsions. However, the increased amplification caused by these types of dye forming materials also directly leads to higher granularity.

It is highly desirable to provide non-imaging materials that lead to increased photographic speed without having to increase the size of the light-sensitive silver halide grains. Ideally, the addition of such materials should not require the use of permanent solvents (non-reactive, non-volatile organic liquids with low aqueous solubility) in order to be introduced or effective in a photographic film. The use of such permanent solvents is generally unfavorable because of cost, film thickness, increased total organic load and environmental factors.

JP 4-107446 describes the use of substituted purines in combination with separate carbonamide substituted polymers in graphic arts systems. U.S. Pat. No. 3,779,769 describes the use of tetraazindenes in combination with separate sulfated vinyl copolymers.

Copending application U.S. Ser. No. 09/221,359 describes the use of certain polymeric heterocycles derived from a monomeric heterocycle with a ClogP of 6.2 or greater to increase the light sensitivity of a photographic element.

U.S. Pat. Nos. 5,213,959 and 5,275,931 describe the use of heterocyclic antifoggants that have a reactive substituent that chemically reacts with the dispersing medium to form a covalent bond in a photographic element to prevent diffusion.

U.S. Pat. Nos. 3,753,956 and 3,576,638 describe the use of polymeric tetrazoles for use as antifoggants.

JP 62-000949A describes the use of polymeric oxadiazoles, thiadiazoles and selenodiazoles as antifoggants, in which all but two examples are substituted with a free thiol group. The two examples that do not have a free thiol group (polymers 8 and 10 on page 392) are based on monomers with ClogP of less than zero.

U.S. Pat. Nos. 3,598,600 and 5,702,877 describe the use of polymeric benzodiazoles in photographic films.

JP 64-019343A2 describes the use of polymeric thiol substituted 1,2,3a,7 and 1,3,3a,7-tetraazaindenes as antifoggants. JP 06-059363A2 describes the use of polymeric 6-hydroxy-1,3,3a,7-tetraazaindenes as addenda for silver halide precipitations. JP 61-134758 describes the use of polymeric 6-hydroxy-1,3,3a,7-tetraazaindenes and polymeric benzotriazoles as antifoggants in instant photography.

U.S. Pat. Nos. 4,528,264 and 5,229,249 describe the use of polymeric benzotriazoles.

A problem to be solved is to provide color photographic elements that exhibit improved photographic speed and methods for processing such elements. In particular it is desirable to provide improved speed using compounds useful over a broader range of ClogP values than heretofore available.

SUMMARY OF THE INVENTION

The invention provides a color silver halide photographic element comprising a light-sensitive silver halide emulsion layer or a non-silver containing light-insensitive layer, said light-sensitive or light-insensitive layer containing a polymer compound comprising a heterocycle unit derived from:

(a) a heterocycle monomer (1) comprising two or more annulated rings containing, in total, a minimum of three ring heteroatoms of which no more than two of the heteroatoms are connected in sequence to each other and (2) having a ClogP less than 6.2; or (b) a monocyclic heterocycle monomer having exactly three ring heteroatoms and having a ClogP less than 8.75;

with the proviso that the heterocycle unit does not contain a hydroxy or mercapto group (or their tautomeric equivalent), and does not react with oxidized developer; and the amount of the polymer compound in the element being sufficient to increase the photographic speed of the element compared to the same element without the compound.

The invention provides color photographic elements that exhibit improved photographic speed and methods for processing such elements.

DETAILED DESCRIPTION OF THE INVENTION

The invention is generally as described above. In various aspects of the invention, the imaging layer that contains the polymer comprises an iodobromide emulsion, is sensitized to green light, comprises a particular grain size, includes a particular type of coupler, is an origination material, and is processed with a color developer such as a paraphenylene diamine developer. In other aspects of the invention, the polymer contains a particular kind of bicyclic heterocycle with a minimum of three heteroatoms including a tetraazaindene (including purine), or a monocyclic heterocycle with exactly three heteroatoms including a 1,2,3-triazole, a 1,2,4-triazole, a thiadiazole or an oxadiazole.

The present invention relates to a light-sensitive color photographic element with at least one red sensitive silver halide emulsion layer with at least one non-diffusing cyan coupler, at least one green sensitive silver halide emulsion layer with at least one non-diffusing magenta coupler and at least one blue sensitive silver halide emulsion layer with at least one non-diffusing yellow coupler, characterized in that at least one light-sensitive silver halide emulsion layer or a non-silver containing light-insensitive layer contains a polymer compound comprising a heterocycle unit derived from:

(a) a heterocycle monomer (1) comprising two or more annulated rings containing, in total, a minimum of three ring heteroatoms of which no more than two of the heteroatoms are connected in sequence to each other and (2) having a ClogP less than 6.2; or (b) a monocyclic heterocycle monomer having exactly three ring heteroatoms and having a ClogP less than 8.75;

with the proviso that the heterocycle unit does not contain a hydroxy or mercapto group (or their tautomeric equivalent), and does not react with oxidized developer; and the amount of the polymer compound in the element being sufficient to increase the photographic speed of the element compared to the same element without the compound. It is desired that the compound of the invention should achieve an improvement in terms of photographic speed, compared to the same element without the compound, of at least 0.05, and desirably at least 0.10 and even 0.25 stops or more without causing a significant increase in granularity.

The term "heteroatom" as used herein encompasses any atom other than carbon or hydrogen and includes, for example, nitrogen, sulfur, phosphorus and oxygen. In the polymeric or monomeric heterocycle of the invention, the term "heteroatom" refers only to those atoms which form an integral part of the ring system and not those that are located externally to the ring system or separated from it by at least one single, unconjugated bond or are part of an additional substituent of the ring system. The term "annulated" as used herein refers to rings that share two adjacent atoms.

The polymeric materials of the invention, or "speed polymers," are preferably polymers that contain a heterocycle unit, whose corresponding monomers meet the ClogP requirement, defined by the following general formula (A):

(A)

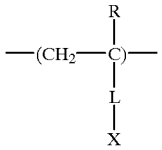

where R is hydrogen or an alkyl or aryl group, L is a linking group and X is a heterocylic subunit similar to compounds known to cause inhibition of silver development, but because of the increased hydrophobicity due to the polymeric form, does not cause inhibition of silver development in elements of the invention.

Typically, R is hydrogen or an alkyl group, preferably having 1 to 6 carbon atoms. Examples of suitable alkyl groups are methyl, ethyl and butyl. Polymers in which R is hydrogen or a methyl group are especially preferred.

L is a divalent linking group that permanently attaches X to the polymeric backbone and preferably, contains 1 to 20 carbon atoms. Preferred linking groups are represented by Formulas L-1 and L-2:

(L-1)

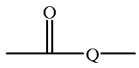

(L-2)

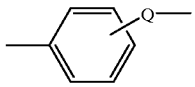

where Q is an oxygen atom, a sulfur atom, a nitrogen atom, a methylene group or a carbonyl group. Examples of particularly preferred linking groups according to Formula L-1 are —CONH— and —$CO_2$—. Examples of particularly preferred linking groups according to Formula L-2 are where Q is —O—, —S—, —NH—, —CO—, —$CH_2$— or —$SO_2$—. There may be optional groups or atoms, such as alkylene groups, that attach Q to X. Some examples of these extended linking groups would be —$CONHCH_2CH_2CONH$—X, —$CO_2CH_2CH_2$—X, —$CONHCH_2CH_2$—O—$CH_2CH_2NHCO$—X, where X is either 1) a polycyclic heterocycle which contains a minimum of three heteratoms, no more than two of which are directly connected to each other in sequence and is not substituted with a hydroxyl or thiol group or 2) a monocyclic heterocycle with exactly three heteroatoms that is not substituted with a hydroxyl or thiol group.

Generally, the appropriately substituted heterocycle serves as a monomer or a comonomer for the preparation of the speed polymer, although it is possible to pre-form the polymer backbone and then attach the heterocycle.

Even though the speed polymers of the invention are not inhibitors of silver development, they are generally derived from heterocycles which are inhibitors of silver development. Any of the following tests could be used to identify if any particular class of compound from which the monomer is derived is of a type within the present invention.

Two different tests of potential inhibiting activity are described in *Photogr Sci and Eng,* 5, 283 (1961) and in *Photogr. Sci and Eng,* 18, 383 (1974). Another test is based on binding to silver ions, which is crucial for inhibition of silver development. Silver chloride is a useful material for emulsion-based photography, the strength of the binding of chloride to silver ions defines a lower limit of binding strength for active materials. Accordingly, the following test defines those classes of molecules that bind to silver ions that are covered under the invention described herein provided they are modified to have the desired minimum ClogP. First, to test a class, an example that is soluble at pH 10 in a carbonate buffer was chosen and a 50 ml solution that is 0.00100 M in the compound, 0.0200 M in potassium bicarbonate, and 0.0267 M in potassium carbonate was prepared and the pH was adjusted to 10.0 with either 1 M nitric acid or sodium hydroxide. With magnetic stirring, and at a temperature between 20 and 25° C. and under nitrogen, there was added 1 ml of 0.000500 M silver nitrate. Using any valid electrochemical method for measuring silver ion concentrations, the free silver ion molarity 15 min after addition was determined. The entire process was repeated at the same temperature and under other conditions with 0.00100 M sodium chloride in place of the test compound. Any substance that lowers the silver ion molarity more than 0.00100 M chloride does is an active class in the invention described herein.

Among the classes of monocyclic compounds that contain exactly three heteroatoms that are known to cause inhibition of silver development (see references in the background of the invention) and can be included in the invention when appropriately substituted are: oxadiazoles, thiadiazoles, oxathiazoles, 1,2,3-triazoles and 1,2,4-triazoles. Among the classes of bicyclic compounds that have at least three heteroatoms of which no more than two are directly connected to each other and can be included in the invention when appropriately substituted are purines and other polyazaindenes. Optionally, there may be other repeating units present in the polymeric backbone. The polymers may also contain two or more different types of these heterocycles. Formulations useful for the purpose of the invention, namely an increase in photographic speed, have the desired overall hydrophobicity and do not cause a significant inhibition of silver development. The hydrophobicity of the speed polymer is governed both by the nature of the polymeric backbone and by the hydrophobicity of the monomeric heterocycle (as measured by ClogP). The minimum and maximum ClogP of the monomeric heterocycle for speed improvement may vary somewhat for each class of compound useful in this invention.

The heterocyclic subunit of the polymer cannot have more than two heteroatoms that are directly bonded to each other in sequence if the heterocycle is composed of two or more annulated rings. An example of a bicyclic heterocycle with 3 heteroatoms directly bonded to each other and not part of the invention is a benzotriazole. If the heterocyclic subunit of the polymer is monocyclic, then the heterocycle must have only 3 heteroatoms. An example of a monocyclic heterocycle with more than three heteroatoms and not part of the invention is a tetrazole. An example of a monocyclic heterocycle with less than three heteroatoms and not part of the invention is an imidazole. In addition, none of the inventive heterocyles may contain free hydroxy (—OH) or mercapto or thiol (—SH) substituents on the heterocyclic nucleus since they interfere with the desired interaction of the polymer with the silver halide grain. It should be noted that nitrogen heterocycles substituted with —OH or —SH groups can often be written in alternative tautomeric forms as keto or thiocarbonyl groups where the hydrogen is located on one of the ring nitrogens; these forms are chemically equivalent to the —OH or —SH forms and are excluded from the invention.

One preferred class of heterocycles used in the invention is polycyclic nitrogen heterocycles, such as those that contain at least two ring systems composed only of carbon and at least three nitrogen atoms. A specific example of a preferred polycyclic nitrogen heterocycles with at least three nitrogen atoms as part of the ring system are tetraazaindenes (including purines). Another preferred class of heterocycles of the invention are monocyclic heterocycles comprising carbon and three nitrogens or carbon and two nitrogen atoms with either one ring sulfur or ring oxygen atom. Specific classes of these preferred heterocycles are 1,2,3-triazoles, 1,2,4-triazoles, oxadiazoles, and thiadiazoles.

The substituents located directly on the heterocyclic subunits of the invention can be hydrogen or any group chosen except —OH or —SH such that together the entire compound meets the overall ClogP requirement and in addition, provide a covalent link to the polymeric backbone. These substituents may be vinyl, alkyl, aryl, alkoxy or aryloxy, alkylthio or arylthio, sulfoxyl, sulfonyl, sulfamoyl

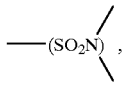

halo such as fluoro, chloro, bromo or iodo, cyano, nitro, —O—CO—, —O—$SO_2$—, a heterocyclic group such as furanyl or morpholino, a carbonyl group such as keto, carboxylic acid (—$CO_2H$), carboxylate ester (—$CO_2$—) or carbamoyl

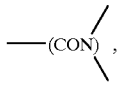

or an amino group such as a primary, secondary or tertiary substituted nitrogen, carbonamido (>NCO—) or sulfonamido (>$NSO_2$—). It should be noted wherever it is possible to write alternative tautomeric structures of the heterocyclic nucleus, these are considered to be chemically equivalent and are part of the invention. In particular, non-tertiary amino groups (—$NH_2$ or —NH') can attached to a ring atom such that conjugation to a ring nitrogen can occur to provide tautomeric forms of the heterocycle.

More preferred forms of the polycyclic nitrogen heterocycles used in the invention contain a 6/6 or 6/5 two-ring bicyclic nucleus which contain at least 4 nitrogen atoms over both ring systems so long as no three nitrogen atoms are consecutive, that is, directly connected to each other. Any particular nitrogen atom may be part of only one ring or be located in a bridgehead position. A bridgehead position is where an atom forms part of more than one ring. In addition, it is possible that other ring systems may be annulated to these heterocyclic ring systems or even be located between these rings so long as two rings (at least one of which must be a six membered ring) contain, between them, at least 4 nitrogen atoms and do not contain 3 nitrogen atoms directly connected to each other. The additional rings may or may not contain additional nitrogen atoms or other heteroatoms such as sulfur or oxygen. None of the rings that comprise the heterocyclic nucleus are isolated or joined only by a single bond. It is preferred that the heterocyclic nucleus be aromatic or pseudo-aromatic.

A particularly preferred form of the heterocycle of the invention is a 6/5 bicyclic aromatic nitrogen heterocycle that contains at least 4 nitrogen atoms as part of the ring system and does not contain 3 nitrogen atoms directly connected to each and is substituted so that the overall ClogP for the monomer compound is no greater than 6.2 and preferably no more than 5.0. The ClogP of the monomeric heterocycle used in the inventive polymer should be at least 0 or suitably at least 1.0.

Some examples of the 6/5 bicyclic heterocycle compounds of the invention are the following tetraazaindenes and pentaazaindenes (numbered according to the structure below): 1,3,4,6 and 1,3,5,7 (both also known as purines); 1,3,5,6; 1,2,3a,4; 1,2,3a,5; 1,2,3a,6; 1,2,3a,7; 1,3,3a,7; 1,2,4,6; 1,2,4,7; 1,2,5,6 and 1,2,5,7. These compounds may also be described as derivatives of imidazo, pyrazolo- or triazolopyrimidines, pyridazines or pyrazines. Some examples of pentaazaindenes are 1,2,3a,4,7; 1,2,3a,5,7 and 1,3,3a,5,7. An example of a hexaazaindene would be 1,2,3a,4,6,7.

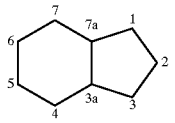

The more preferred examples are in which the 6/5 bicyclic nitrogen heterocycle are 1,3,4,6; 1,2,5,7; 1,2,4,6; 1,2,3a,7 or 1,3,3a,7-tetraazaindene derivatives.

The most preferred examples of a purine derivative are according to Formula I:

I

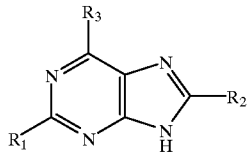

wherein $R_1$ and $R_2$ are each independently hydrogen or an alkyl, aryl, alkoxy or aryloxy, alkylthio or arylthio, sulfoxyl, sulfonyl, sulfamoyl, halo such as fluoro, chloro, bromo or iodo, cyano, nitro, —O—CO—, —O—$SO_2$—, a heterocyclic group, a carbonyl group such as keto, carboxylic acid , carboxylate ester or carbamoyl or an amino group such as a primary, secondary or tertiary substituted nitrogen, carbonamido or sulfonamido. $R_3$ is an alkyl, aryl, alkoxy, aryloxy, alkylthio, arylthio, sulfonyl, sulfoxyl, secondary or tertiary amino group, carbonamido group or a sulfonamido group all of which may be substituted as provided hereinafter. The heterocycle may be linked to the polymeric backbone through any of $R_1$, $R_2$ or $R_3$. Compounds in which $R_3$ is an alkoxy or alkylthio group and which provide a link to the polymeric backbone are especially preferred. The overall ClogP should be no greater than 6.2, or more preferably, no more than 5.0.

The most preferred examples of a 1,2,5,7-tetraazaindene derivative are according to Formula IIa or a 1,2,4,6-tetraazaindene derivative are according to Formula IIb:

IIa

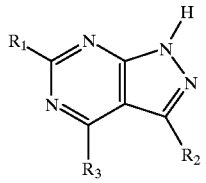

IIb

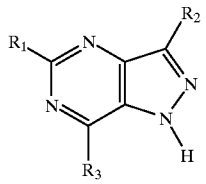

wherein $R_1$, $R_2$ and $R_3$ are each defined above. Compounds in which $R_3$ is an alkoxy or alkylthio group and which provide a link to the polymeric backbone are especially preferred. The overall ClogP should be no greater than 6.2, or more preferably, no more than 5.0.

The most preferred examples of a 1,2,3a,7-tetraazaindene derivative are according to Formula III:

III

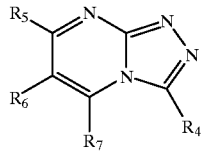

wherein $R_4$, $R_5$, $R_6$ and $R_7$ are each as defined for $R_1$ and $R_2$. Compounds in which $R_4$ is an alkyl, aryl, alkoxy, arylthio, or alkylthio group and in which $R_7$ provides a link to the polymeric backbone being particularly beneficial. The overall ClogP should be no greater than 6.2, or more preferably, no more than 5.0.

The most preferred examples of a 1,3,3a,7-tetraazaindene derivative are according to Formula IV:

IV

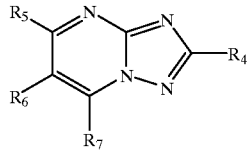

wherein $R_4$, $R_5$, $R_6$ and $R_7$ are the same as for Formula III. Especially preferred are compounds where $R_4$ is an alkyl, aryl, alkoxy, arylthio, or alkylthio group and in which $R_7$ provides a link to the polymeric backbone being particularly beneficial. The overall ClogP should be no greater than 6.2, or more preferably, no more than 5.0.

A preferred form of the monocyclic heterocycle of the invention is a 1,2,4-triazole in which the overall ClogP for the compound is no greater than 8.75, or more preferably no more than 7.0 or most preferably no more than 5.05 and equal to or greater than 0. The more preferred examples of a 1,2,4-triazole is according to Formula V wherein $R_{12}$ and $R_{13}$ are each individually defined as for $R_1$ and $R_2$ above. The most preferred examples are where $R_{12}$ is hydrogen, alkyl or aryl and $R_{13}$ is an alkylthio or arylthio, carboxylate ester or substituted alkyl group.

V

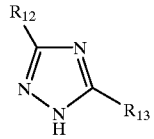

Another preferred form of the monocyclic heterocycle of the invention is a 1,2,3-triazole in which the overall ClogP for the compound is no greater than 8.75, or more preferably no more than 7.0 or most preferably no more than 5.05 and equal to or greater than 0. The more preferred examples of a 1,2,3-triazole is according to Formula VI wherein $R_{12}$ and $R_{13}$ are each individually defined as for $R_1$ and $R_2$ above. The most preferred examples are where $R_{12}$ is hydrogen, alkyl or aryl and $R_{13}$ is an alkylthio or arylthio, carboxylate ester or substituted alkyl group.

VI

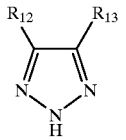

Another preferred form of the monocyclic heterocycle of the invention is a diazole in which the overall ClogP for the compound is no greater than 7.6, or more preferably no more than 6.5 or most preferably no more than 5.0 and equal to or greater than 0. The more preferred examples of a diazole are according to Formula VII wherein X is oxygen or sulfur and $R_{14}$ and $R_{15}$ are each individually defined as for $R_1$ and $R_2$. The most preferred examples of an oxadiazole (X=O) or a thiadiazole (X=S) are where $R_{14}$ is an alkylthiol or arylthio group and $R_{15}$ is an alkyl, aryl, alkylthio or arylthio or amino group.

VII

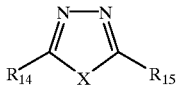

The heterocyclic fragments in the polymers of the invention are not couplers and do not react with oxidized developer (Dox) to generate dyes or any other product. The heterocycles are stable to other components of the processing solutions and do not contain substituents that undergo substantial amounts of chemical reaction in any of the processing solutions (except when the compound has a suitable NH bond replaced by a temporary blocking group that is removed in a non-imagewise fashion as detailed below). For example, the heterocyclic fragments do not contain hydrazino or hydroquinone substituents that may cross-oxidize during silver development. However, the heterocyclic fragments may contain, for example, ester substituents that are not substantially hydrolyzed (less than 5–10%) during the development process.

It is desired that the polymeric backbone of the materials of the invention does not undergo any significant amounts (less than 5–10%) of chemical or redox reaction directly with oxidized color developer or other components of the processing solutions. The heterocyclic fragments are permanently bonded to the polymeric backbone and are not released from the polymeric backbone during processing. The polymers are colorless as coated. However, the polymeric backbone may contain other pendant groups in addition to the heterocyclic fragments that do react with Dox to form colored dyes or release photographically useful groups (PUGs) in an imagewise fashion. Examples would be polymers with the appropriate heterocyclic fragments that additionally contain coupling species such as pyrazolones or napthols independently attached to the polymer backbone. The polymeric compounds of the invention are located in the film element as described and are not added to the processing solutions.

An important feature of the polymers of the invention is their hydrophobicity which is partially related to their octanol/water partition coefficient (logP) of the heterocyclic monomer from which the polymer is formed. If the partitioning into water of the heterocyclic fragment is too high, then silver inhibition occurs. However, by attaching a heterocyclic fragment with the appropriate degree of inherent hydrophobicity (as measured by ClogP) to a polymeric backbone, then silver inhibition is prevented and the photographic speed effect is maximized. Because it can be difficult to measure logP values above 3, a model can be used to compute an estimate of logP, called ClogP that defines the limits of the monomers used in the invention. The model used is MEDCHEM Version 3.54, which is a software program produced by the Medicinal Chemistry Project at Pomona College in California.

One way to enter a structure into the MEDCHEM program in order to calculate a ClogP is through a SMILES string. The way to enter the SMILES string for a nitrogen compound is to enter all non-hydrogen atoms as capitals and let the MEDCHEM program determine the appropriate aromaticity. An example is shown for monomeric heterocycle MH-2 below:

C=CC1=CC=CC (COCCCOC2=C3N=CNC3=NC=N2)=C1.

This entry gives the value 1.94. When the entry is in this form, the heterocyclic N—H will be drawn in the structure by the MEDCHEM program. If the entry is not in this form, the MEDCHEM program will not display the heterocyclic N—H group and the resulting ClogP value is incorrect. Structures such as MH-1 can be drawn in multiple tautomeric forms, for example, hydrogens on different ring atoms, enol or keto tautomeric forms (or thiol or thione forms for sulfur compounds). If ClogP values can be calculated for more than one tautomeric form of a single compound and at least one of those values is within the specified range for that class, then the compound is within the scope of the invention. Some tautomers may not compute in MEDCHEM 3.54, because there is a fragment in the molecule that is missing in the MEDCHEM database. In such a case, logP of the nucleus of the molecule (with appropriate aromatic or aliphatic substituents) must be experimentally measured and the missing fragment value must be entered into the algorithm manager of MEDCHEM as instructed by the manual. For the purposes of this invention, the ClogP refers to neutral monomeric molecules, even if they would be ionized or protonated (either fully or in part) at the processing pH or at the ambient pH of the photographic film. In addition, in the case where the polymer is not directly formed from a heterocyclic monomer but is prepared by reacting a pre-formed polymer with the appropriate heterocyclic nucleus, the ClogP should be calculated on the basis of the entire heterocylic subunit (as in general Formula (A)) including any linking groups and that part of the polymer which would been part of the corresponding monomeric species.

There in a specific range of ClogP for each class of heterocyclic monomers, depending on its particular nature, which should not be exceeded. For most examples, it is preferred that the ClogP not exceed 5.0 or more preferably for some types of compounds, not to exceed 8.75. For monocyclic heterocycles, the ClogP should be equal to or greater than zero.

One of the most important and novel characteristics of the polymers of this invention is the finely tuned balance between their hydrophobic and hydrophilic nature. The hydrophobic/hydrophilic nature of a compound can be estimated by calculation of its partition coefficient between octanol and water (ClogP) using the MEDCHEM program, and this has been used herein to define the range of values of ClogP for each class of monomer within which they exhibit the desired effect when included as part of a polymer. The ClogP limitations apply only to the monomeric heterocycle fragment and not the overall polymer whose hydrophobicity can be controlled separately. The terms 'ballast' or 'ballasted' as generally applied in the photographic art are often applied only loosely and without quantification to imply a restriction of movement. The activity of the monomeric heterocycle is therefore best defined in terms of their ClogP values.

For each compound of the invention, as the laydown is increased a threshold level is reached following which the speed improvement gradually increases with laydown, after which the improvement then levels off at a compound specific maximum level. It will be appreciated that the amount is also a function of other variables such as the location and number of layers in which the compound is located, the solvent used, and film dimensions. Thus, it is desirable to have enough laydown of the compound in order to obtain the speed improvement. Suitably, there is present sufficient laydown to achieve an improvement of at least 0.05, and desirably at least 0.10 and even 0.25 stops or more. Where the polymer is present in a sensitized layer, the ratio of polymer to silver is suitably at least 0.1 mmol of heterocyclic compound in the polymer per mol of silver and, more preferably, at least 1.0 mmol of heterocyclic compound in the polymer per mol of silver and, most preferably, at least 2.0 mmol per mol of silver. When coated in a non-silver containing layer, the laydown of the heterocyclic compound in the polymer is suitably at least $3\times10^{-5}$ mol/m$^2$ or greater, or more preferably, at least 0.0001 mol/m$^2$ or greater.

The following are examples of monomeric heterocyclic compounds, along with the corresponding ClogP values, that are useful as part of a polymer in this invention:

MH-1:
(3.52)

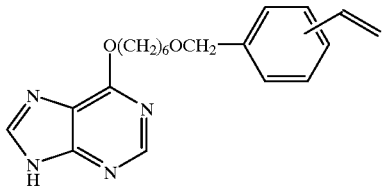

(mixture of 70% meta and 30% para isomers)

MH-2:
(1.94)

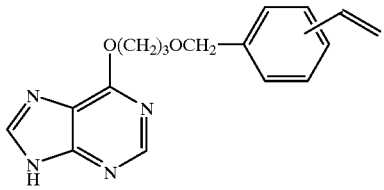

(mixture of 70% meta and 30% para isomers)

MH-3:
(2.21)

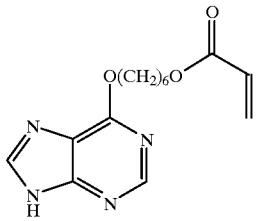

-continued

MH-4:
(0.97)

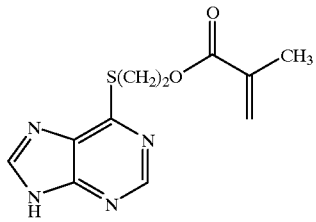

MH-5:
(0.12)

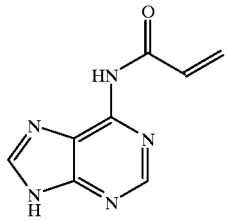

MH-6:
(0.98)

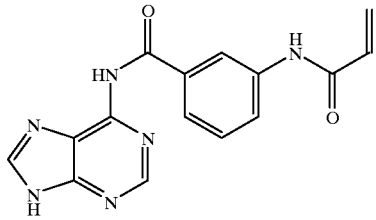

MH-7:
(1.93)

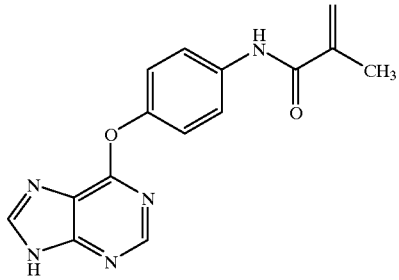

MH-8:
(2.09)

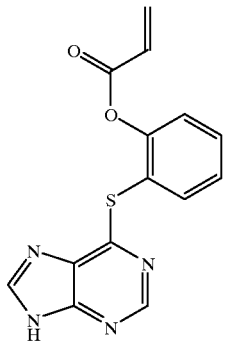

MH-9:
(0.82)

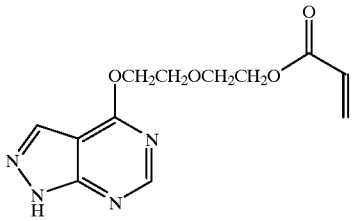

-continued

MH-10:
(2.04)

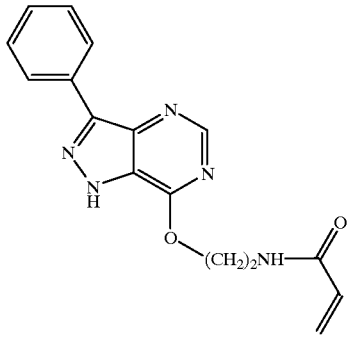

MH-11:
(0.64)

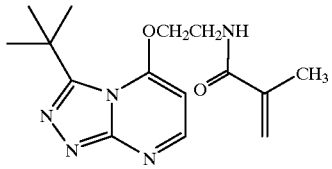

MH-12:
(2.29)

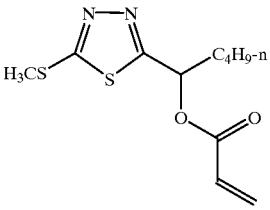

MH-13:
(2.81)

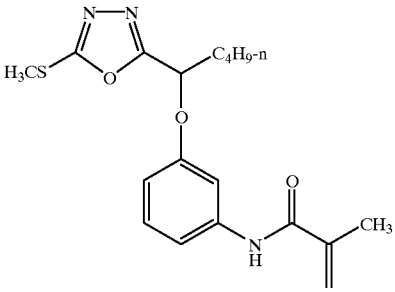

MH-14:
(0.62)

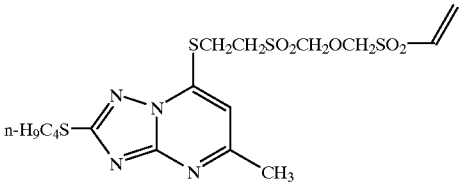

MH-15:
(3.52)

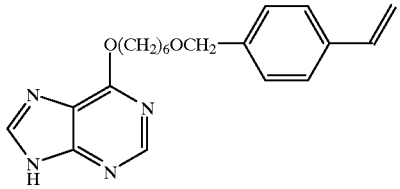

-continued

MH-16:
(1.94)

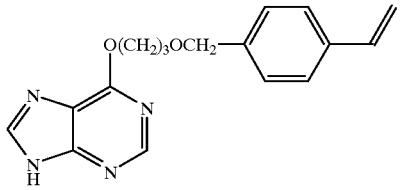

MH-17:
(2.11)

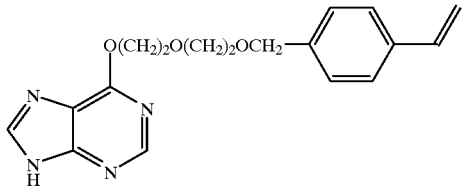

MH-18:
(2.18)

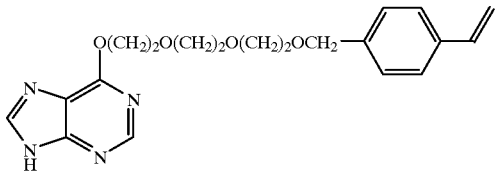

MH-19:
(2.56)

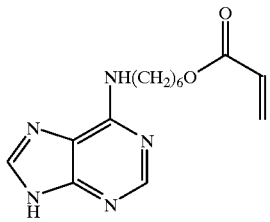

MH-20:
(−0.56)

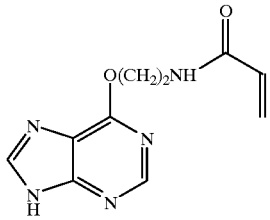

MH-21:
(0.29)

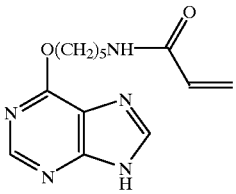

To adjust the water solubility of the polymers, an ionizable comonomer is preferred. Ionizable monomers contains an ionizable functional group selected from the group consisting of sulfonates, sulfates, phosphates, and carboxylic acids, with sulfonates and sulfates being particularly preferred. They can be represented by the following general formula (B):

(B)

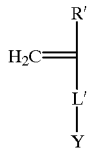

where R' is hydrogen or an alkyl or aryl group, L' is a linking group as defined before (as L) and Y is an ionizable subunit such as a sulfonate, sulfate, phosphate, carboxylate, thiosulfate or sulfinate, with sulfonate and sulfate being particularly preferred. Suitable ionic monomers include acrylic acid and its derivatives such as alpha-chloroacrylic acid and alpha-alkylacrylic acid (such as methacrylic acid, etc.) or other vinylogous acids such as itaconic acid, citraconic acid or crotonic acid, as well as, but not limited to, the following:

IM-1:

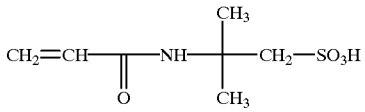

IM-2:

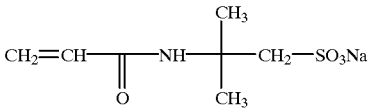

IM-3:

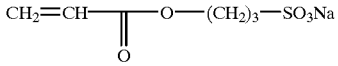

IM-4:

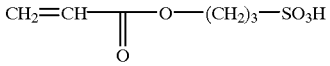

IM-5:

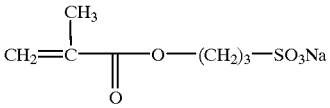

IM-6:

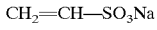

IM-7:

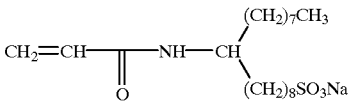

IM-8:

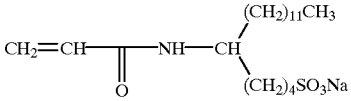

IM-9:

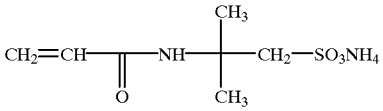

IM-10:

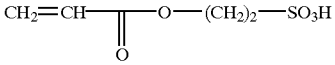

-continued

IM-11:

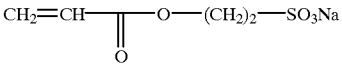

IM-12:

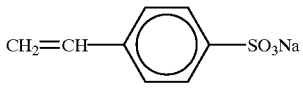

IM-13:

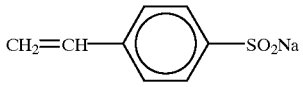

IM-14:

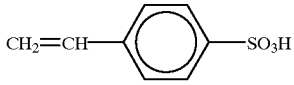

IM-15:

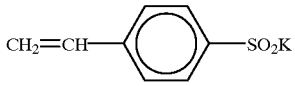

IM-16:

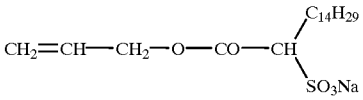

IM-17:

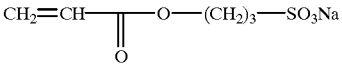

Optionally, a third monomer can be used to additionally adjust the hydrophobicity and Glass Transition Temperature (Tg) of the polymers. Monomers suitable for this application include an ester or amide derived from an acrylic acid or one of its derivatives (for example, acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, tetrahydrofuryl acrylate, methyl methacrylate, ethyl methacrylate, n-butyl methacrylate, .beta.-hydroxy methacrylate, tetrahydrofuryl methacrylate, etc.), a vinyl ester (for example, vinyl acetate, vinyl propionate, vinyl laurate, etc.), acrylonitrile, methacrylonitrile, an aromatic vinyl compound (for example, styrene or a derivative thereof, vinyl toluene, divinyl benzene, vinyl acetophenone, etc.), vinylidene chloride, a vinyl alkyl ether (for example, vinyl ethyl ether, etc.), an ester of maleic acid, N-vinyl-2-pyrrolidone, N-vinylpyridine, 2- or 4-vinylpyridine, etc. Of these monomers, an ester of acrylic acid, an ester of methacrylic acid, and styrene and styrene derivatives are particularly preferred. Two or more ethylenic unsaturated monomers can be used together. For example, a combination of methyl acrylate and butyl acrylate, ethyl acrylate and styrene, tetrahydrofuryl methacrylate and ethyl acrylate, methyl acrylate and ethyl acrylate, etc., can be used.

When more than two monomers are present in the speed polymer, the weight percent of the hetereocyclic monomer as defined by Formula (A) is suitably from 10 to 90% and preferably from 20 to 50%. The weight percent of ionic monomer as defined by Formula (B) is suitably from 10 to 90% and preferably from 20 to 80%. The weight percent of a third monomer not defined by Formula (A) and Formula (B) can be from 10 to 50% and preferably from 10 to 30%.

The polymer of this invention can be prepared by solution polymerization techniques. Solution polymerization is well known in the art and can be found, for example, in "High Polymers, Vol. X, Polymer Processes", Calvin E. Schildknecht, Ed., Interscience Publishers, Inc. New York (1956), pp.175–194. Examples of the chemical initiators which may be used include a thermally decomposable initiator, for example, a persulfate (such as ammonium persulfate, potassium persulfate, sodium persulfate), hydrogen peroxide, 4,4'-azobis(4-cyanovaleric acid), 2,2'-azobis (2-methyl-N-(2-hydroxyethyl)propionamide), 2,2'-azobis-(2-amidinopropane)dihydrochloride, 2,2'-azobis(N,N'-dimethyleneisobutylramidine), and redox initiators such as hydrogen peroxide-iron(II) salt, potassium persulfate-sodium hydrogensulfate, potassium persulfate-sodium metabisulfite, potassium persulfate-sodium hydrogen bisulfite, cerium salt-alcohol, etc. Suitable solvents for the polymerization include water, methanol, ethanol, propanol, isopropanol, DMF, DMSO, N-methyl pyrrolidone, N,N-dimethylacetamide, ethyleneglycol, diethyleglycol, triethyleneglycol, etc. Two or more solvents can be used together such as methanol/water, and DMF/water, etc.

The solubility of the polymer in water is suitably from 0.5% to 50% by weight (25° C.) and preferably from 2.5% to 50%. The architecture of the polymeric heterocycles can be random, alternate, block, graft, star or dendritic polymers. The molecular weight of the polymeric heterocycles is suitably from 1000 to 1,000,000 and preferably from 3000 to 50,000. Tg of the polymeric heterocycles is suitably from −40° C. to 250° C. and preferably from 0 to 200° C.

Some examples of the polymeric heterocycles of the invention are:

P-1: a polymer prepared from MH-1 and IM-12 at a 50:50 ratio.

P-2: a polymer prepared from MH-1 and IM-12 at a 20:80 ratio.

P-3: a polymer prepared from MH-2 and IM-12 at a 50:50 ratio.

P-4: a polymer prepared from MH-2 and IM-12 at a 20:80 ratio.

P-5: a polymer prepared from MH-1 and IM-5 at a 50:50 ratio.

P-6: a polymer prepared from MH-2 and IM-5 at a 50:50 ratio.

P-7: a polymer prepared from MH-1 and IM-5 at 20:80 ratio.

P-8: a polymer prepared from MH-2 and IM-5 at 20:80 ratio.

P-9: a polymer prepared from MH-15 and IM-12 at 50:50 ratio.

P-10: a polymer prepared from MH-15 and IM-12 at 20:80 ratio.

P-11: a polymer prepared from MH-16 and IM-12 at 50:50 ratio.

P-12: a polymer prepared from MH-16 and IM-12 at 20:80 ratio.

P-13: a polymer prepared from MH-17 and IM-12 at 50:50 ratio.

P-14: a polymer prepared from MH-18 and IM-12 at 50:50 ratio.

P-15: a polymer prepared from MH-3 and IM-5 at 20:80 ratio.

P-16: a polymer prepared from MH-4 and IM-5 at 20:80 ratio.

P-17: a polymer prepared from MH-5 and IM-5 at 20:80 ratio.

P-18: a polymer prepared from MH-6 and IM-5 at 20:80 ratio.

P-19: a polymer prepared from MH-7 and IM-5 at 20:80 ratio.

P-20: a polymer prepared from MH-8 and IM-5 at 20:80 ratio.

P-21: a polymer prepared from MH-9 and IM-5 at 20:80 ratio.

P-22: a polymer prepared from MH-10 and IM-5 at 20:80 ratio.

P-23: a polymer prepared from MH-11 and IM-5 at 20:80 ratio.

P-24: a polymer prepared from MH-12 and IM-5 at 20:80 ratio.

P-25: a polymer prepared from MH-13 and IM-5 at 20:80 ratio.

P-26: a polymer prepared from MH-14 and IM-5 at 20:80 ratio.

The materials of the invention can be added to a mixture containing silver halide before coating or, more suitably, be mixed with the silver halide just prior to or during coating. In either case, additional components like couplers, doctors, surfactants, hardeners and other materials that are typically present in such solutions may also be present at the same time. The materials of the invention may be added directly if water soluble, dissolved in an organic water miscible solution such as methanol, acetone or the like or added as a latex or suspension. In addition, one or more permanent solvents can be added to the polymer. However, it is desirable to provide these color photographic elements with no or minimal increase in the levels of permanent solvents. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Permanent solvents can also be described in terms of physical constants such as alpha, beta and pi* as defined by M. J. Kamlet, J-L. M. Abboud, M. H. Abraham and R. W. Taft, J. Org Chem, 48, 2877(1983). The preferred permanent solvents used in conjunction with the materials of the invention are those with ClogP of 5.0 or greater and beta values of 0.4 or greater or more preferably, beta values of 0.5 or greater. Preferred classes of solvents are carbonamides, phosphates, alcohols and esters. When a solvent is present, it is preferred that the weight ratio of compound to solvent be at least 1 to 0. 1, or most preferably, at least 1 to 0.5. The materials of the invention may also be dispersed as an admixture with another component of the system such as a coupler or an oxidized developer scavenger so that both are present in the same oil droplet.

The sensitivity of the human eye is greatest to green light and so, the polymers of the invention are most useful when located in or adjacent to the green record (the layer whose maximum spectral sensitivity to light falls between 500 and 600 nm). The following magenta couplers are particularly beneficial when used in conjunction with the polymeric heterocycles of the invention:

M-1
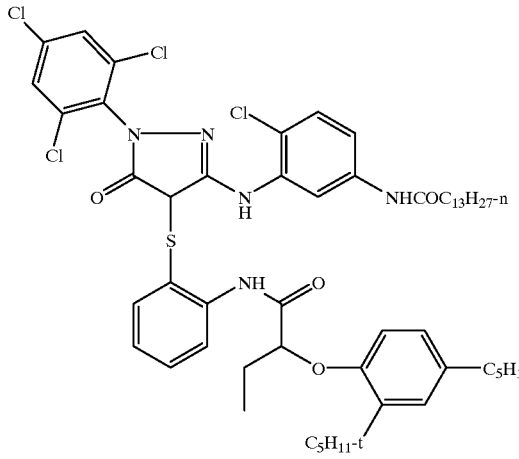
M-2
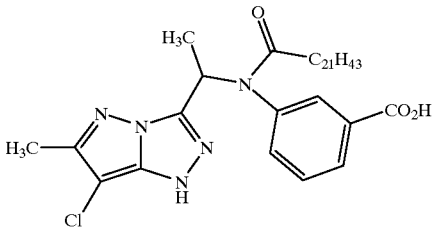
M-3
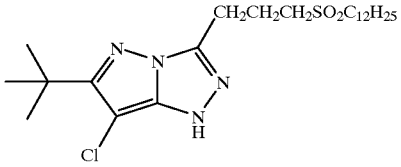
M-4
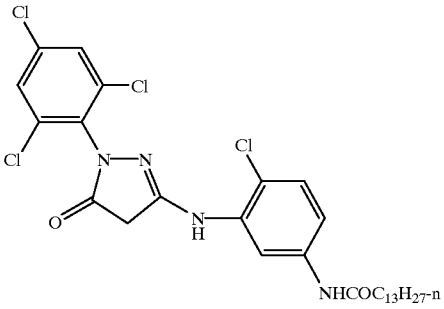
M-5
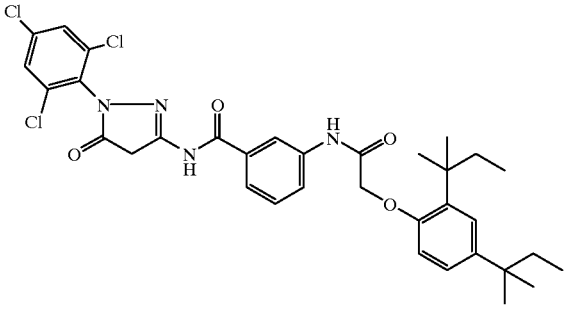
-continued
M-6
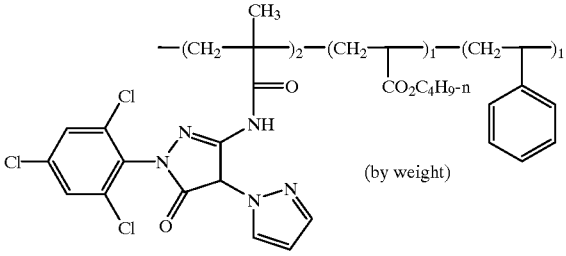
M-7
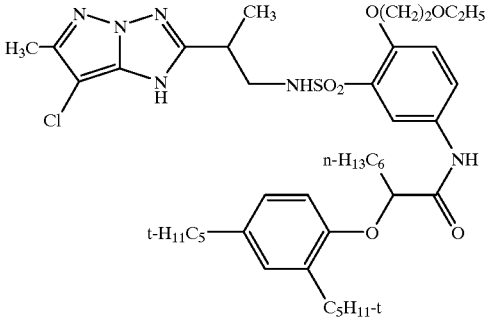
M-8
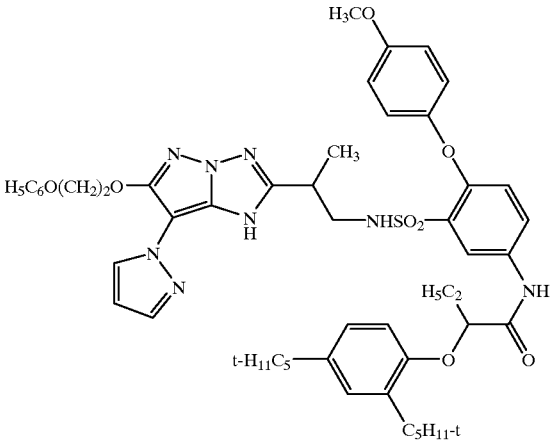
M-9
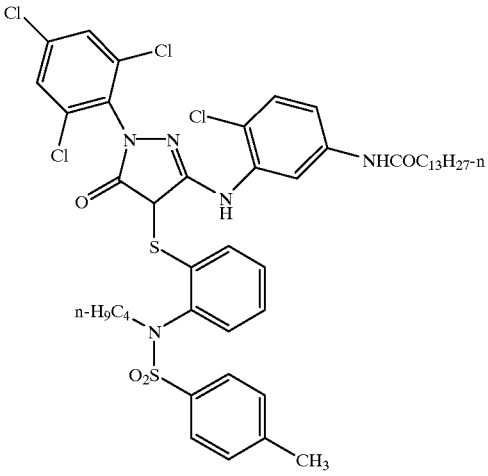

-continued
M-10
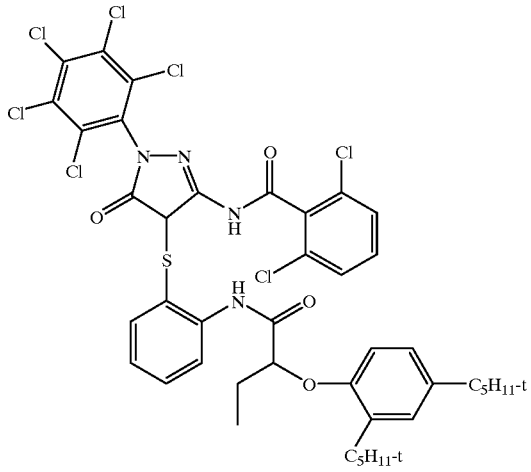
M-11
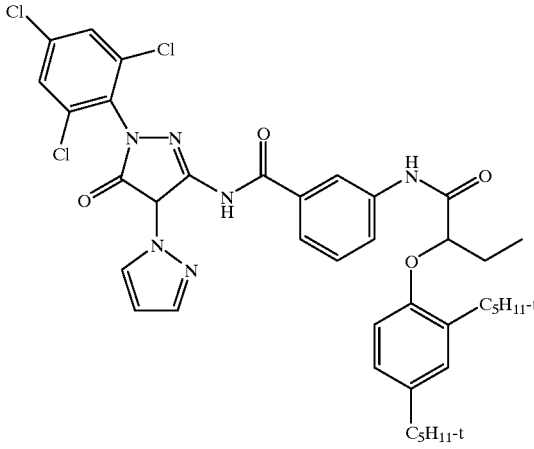
M-12
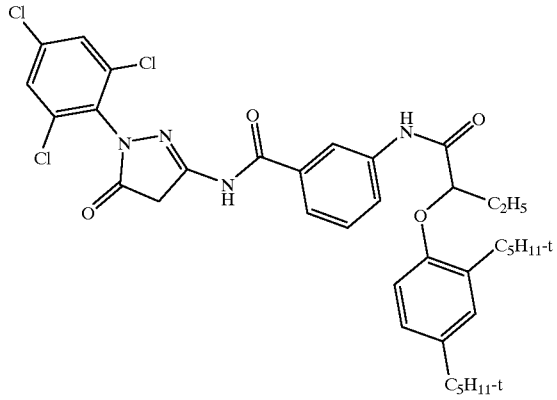
The following green sensitizing dyes are also particularly beneficial when used in combination with the polymeric heterocycles of the invention:
GSD-1
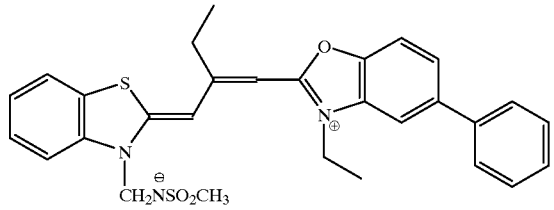
GSD-2
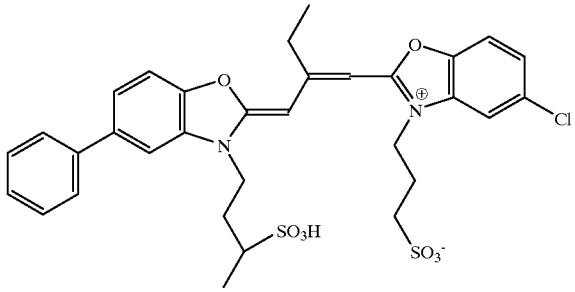
GSD-3
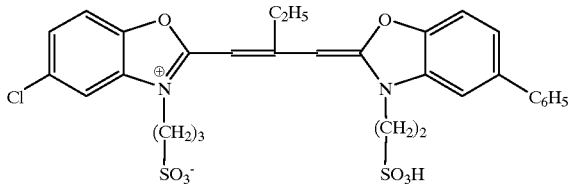
GSD-4
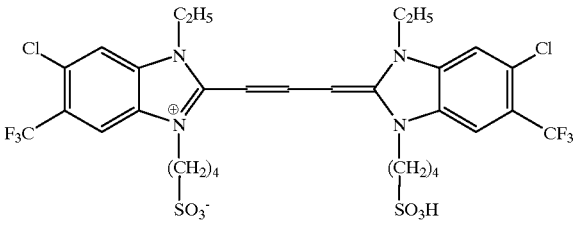
GSD-5
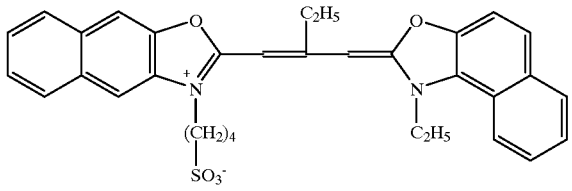
GSD-6
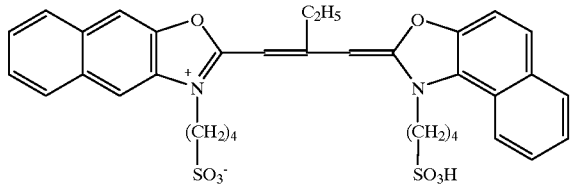

-continued

GSD-7

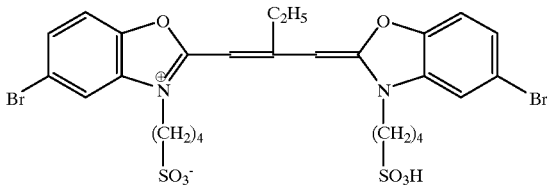

GSD-8

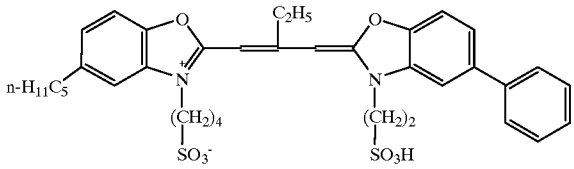

GSD-9

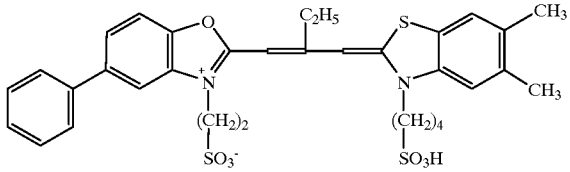

GSD-10

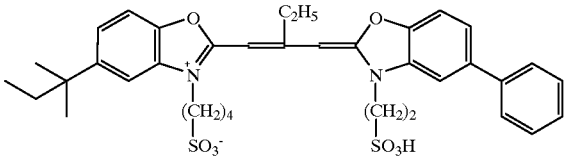

GSD-11

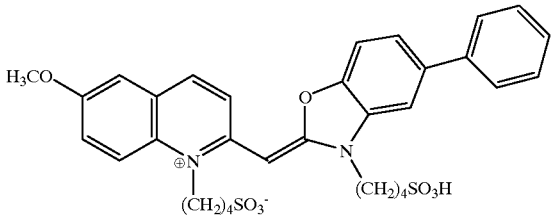

The type of light-sensitive silver halide emulsion used in the layer that contains the polymer of the invention may be important to obtain the desired increase in light sensitivity. The silver halide emulsion is suitably a silver iodobromide emulsion, meaning an emulsion that is low in chloride. By low in chloride, it is meant that there should be no more than 20 mol %. More suitably, there is present in the layer no more than 10 mol % chloride, and typically no more than 1 mol % chloride. The emulsion suitably contains at least 0.01 mol % iodide, or more preferably, at least 0.5 mol % iodide or most preferably, at least 1 mol % iodide. The benefit of the increase in light sensitivity is most apparent in combination with larger sized emulsions that are associated with increased granularity. Thus, it is preferred that the compounds of the invention are used with emulsions that have an equivalent circular diameter of at least 0.6 micrometer, or more preferably, at least 0.8 micrometer, or most preferably, at least 1.0 micrometer. In addition, the benefit of the invention is greatest in origination materials such as color negative or color reversal materials since they require higher sensitivity to light (because of the variable lighting conditions in natural scenes) and low granularity (due to high magnification) relative to color print materials for which exposure conditions are carefully controlled and which are viewed directly under low magnification conditions.

The polymers of the invention are also particularly useful when used in film elements that contain low overall silver levels. Thus, films containing 9 g/m$^2$ of total silver or less, or more preferably 5.4 g/m$^2$ or less or even 4.3 g/m$^2$ or less benefit from the use of the compounds of the invention.

In order to control and maintain granularity over a wide exposure range, it is a common practice to divide an individual color record into separate layers, each containing silver halide emulsions of different degree of sensitivity to the same color of light. While the polymer of the invention is most useful in the most light-sensitive layer, it can be used in more than one record that is sensitive to the same color of light. For example, in a color record that is split into three layers of different relative sensitivity; fast (F), mid (M) or slow (S), the compound can be used in each layer only or in any combination ; i.e. F+M, F+M+S, F+S, etc. It is not necessary that these layers be adjacent; that is, they may have interlayers or even imaging layers that are sensitive to other colors located between them. In addition, although the most light-sensitive layer is typically located in the film structure closest to the exposure source and farthest from the support, the compounds of the invention allow for alternative locations of the layers; for example, a more light-sensitive layer containing the compound of the invention may be located below (farther from the exposing source) than a less sensitive layer. It is also possible to use the polymers of the invention in more than one color record at a time.

Moreover, when a number of layers of the same spectral sensitivity but of differing degrees of sensitivity to light are used, it is known that overall granularity can be minimized by using a smaller molar amount of dye-forming coupler than silver in the layers of higher sensitivity. Thus, it is preferred that the layers containing the compound of the invention additionally contain less than a stoichiometric amount of total dye forming coupler(s) relative to the amount of silver contained in the same layer. A suitable molar ratio of dye-forming coupler(s) to silver in the layer containing the compound of the invention would be less than 0.5. Most preferred would be a ratio of 0.2 or even 0.1 or less.

It is known that film elements can contain silver halide emulsions in one layer that have maximum sensitivities that are separated or shifted from emulsions in other layers that are sensitive to the same color of light (for example, a layer containing an emulsion with maximum sensitivity at ~530 nm whereas another layer contains a different green light-sensitive emulsion which is most sensitive at ~550 nm) are useful for increasing the amount of interimage and improving color reproduction. The layer containing the emulsions with shifted sensitivities may not contain any image couplers at all, but rather only inhibitor releasing couplers (DIRs or DIARs (Development Inhibitor Anchimeric Releasing couplers)) or colored masking couplers. The polymers of the invention are particularly useful in this type of application since they allow for the improved color reproduction while maintaining or increasing speed of the element.

The desired effect of the invention can also be obtained when the polymer of the invention is located in a non-silver containing light-insensitive layer, especially one that is preferably adjacent to an imaging layer, particularly the most sensitive layer of a multilayer record. Preferably, the light-insensitive layer is an interlayer located between two light-sensitive imaging layers. The interlayer can be located between two imaging layers sensitive to the same color or different. It is also possible that the interlayer containing the polymer is located between an imaging layer and an anti-halation layer. The interlayer may also contain additional materials such as oxidized developer scavengers or colored organic filter dyes. It is preferred for this embodiment that the compound be located in a non-silver containing interlayer between the blue and green sensitive color records or a non-silver containing interlayer between the green and red sensitive color records. The non-light-sensitive layer containing a polymer of the invention cannot additionally contain either metallic silver or any type of finely divided silver salt.

The polymers of the invention tend to increase the Dmin of the emulsion layer in which they are coated. Thus, it is often highly advantageous to use the compounds of the invention in combination with any of the antifoggants or scavengers known in the art to be useful in controlling Dmin or fog. Specific examples of scavengers for oxidized developers would be 2,5-di-t-octylhydroquinone, 2-(3,5-bis-(2-hexyl-dodecylamido)benzamido)-1,4-hydroquinone, 2,4-(4-dodecyloxybenzenesulfonamido)phenol, 2,5-dihydroxy-4-(1-methylheptadecyl)benzenesulfonic acid or 2,5-di-s-dodecylhydroquinone. Specific examples of useful antifoggants are compounds AF-1 to AF-8 whose structures are shown below as well as 4-hydroxy-6-methyl-1,3,3a,7-tetraazaindene:

AF-1:

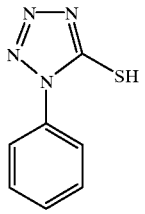

AF-2:

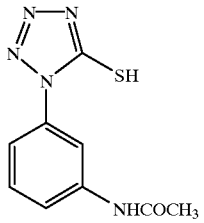

AF-3:

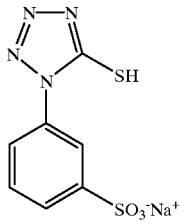

-continued

AF-4:

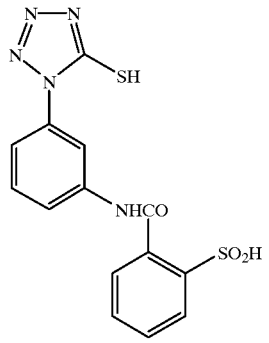

AF-5:

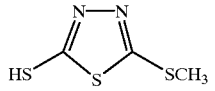

AF-6:

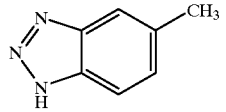

AF-7:

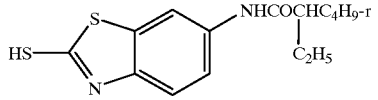

AF-8:

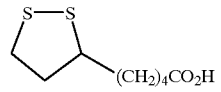

If the compounds of the invention have a suitable N—H group, the hydrogen may be optionally replaced with a group that is removed in a non-imagewise fashion during the development step to regenerate the original N—H group. This offers the advantage of minimizing or avoiding undesirable interactions of the compound with the silver halide emulsion before processing. In this case, it is the ClogP of the unblocked monomeric heterocycle that is important and should be calculated with the hydrogen present and without the blocking group. Any of the temporary blocking groups known in the art to decompose in the developer in a non-imagewise manner can be used for this purpose. Particularly useful are those blocking groups that rely on some specific component of the developer solution to cause decomposition and regeneration of the original substituent. One example of this kind of blocking group, which relies on the hydroxylamine present in the developer, is described in U.S. Pat. No. 5,019,492.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorus, or sulfur. The substituent may be, for example, halogen, such as chlorine, bromine, iodine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

As used herein, the term "color photographic element" means any element containing a light-sensitive silver halide emulsion layer containing an image dye-forming coupler. They can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. A single color element may comprise a combination of couplers in one or more common layers which upon processing together form a monocolor, including black or gray, (so-called chromogenic black and white) dye image.

A typical color photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, or subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the w emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosures* Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color-developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color-developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO0 428 902; EPO0 459 331; EPO0 467 327; EPO0 476 949; EPO0 487 081; EPO0 489 333; EPO0 512 304;EPO0 515 128; EPO0 534 703;EPO0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO0 629 912;EPO0 646 841,EPO0 656 561; EPO0 660 177; EPO0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color-developing agents.

Couplers that form yellow dyes upon reaction with oxidized color-developing agent are described in such representative patents and publications as: "Farbkuppler-eine Literature Ubersicht," published in Agfa Mitteilungen; Band III; pp.112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0327 976; EPO0 296 793; EPO0 365 282; EPO 0 379 309; EPO0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color-developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color-developing agent.

Couplers that form black dyes upon reaction with oxidized color-developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color-developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. 5,019,492.

The invention materials may further be used in combination with image-modifying compounds that release PUGS such as "Developer Inhibitor-Releasing" compounds (DIRs). DIRs useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) that also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

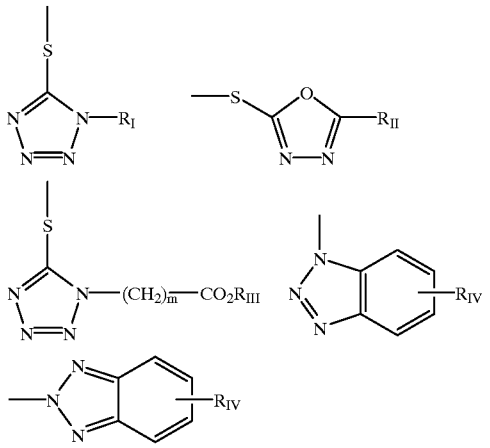

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features described above. It is typical that the timing group is of one of the formulas:

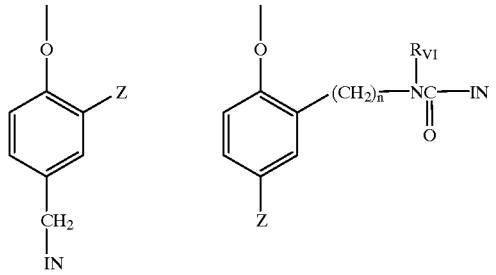

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light-sensitive emulsion layer include, but are not limited to, the following:

D1

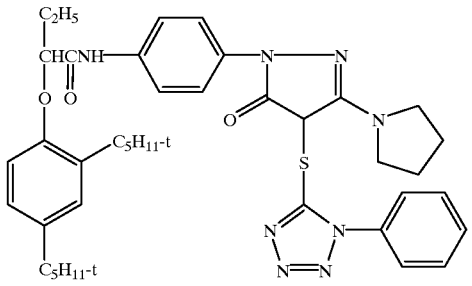

D2

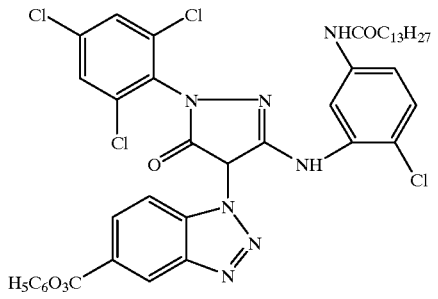

D3

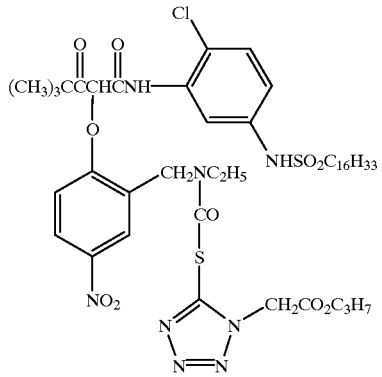

-continued
D4
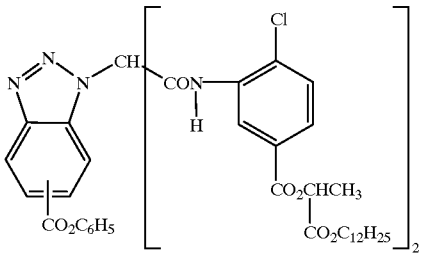
D5
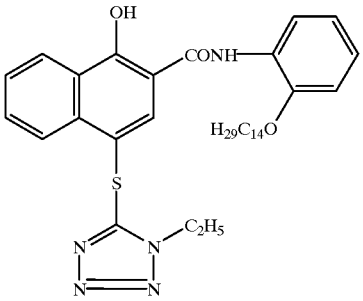
D6
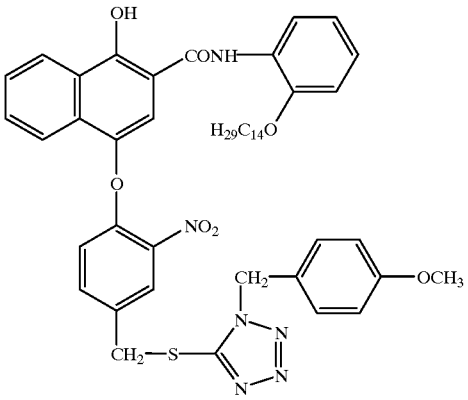
D7
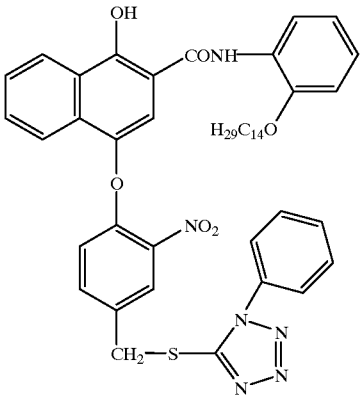
-continued
D8
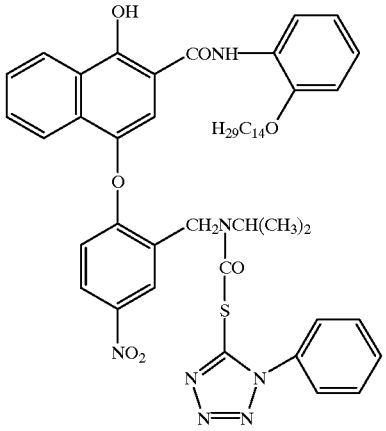
D9
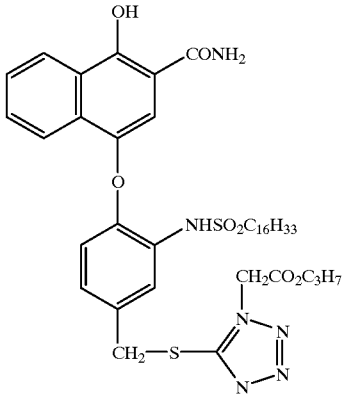
D10
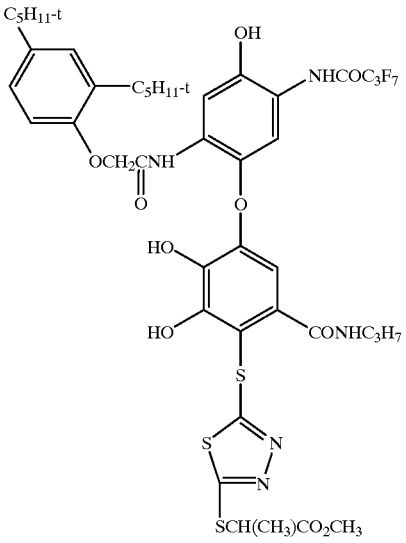

-continued

D11

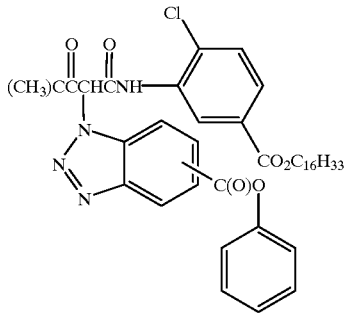

D12

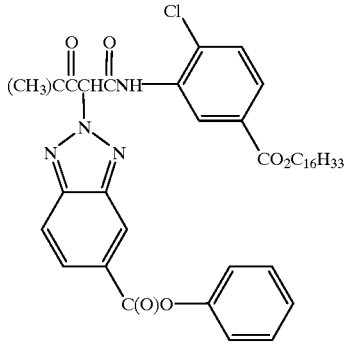

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). The major faces of the tabular grains can lie in either {111} or {100} crystal planes. Specifically contemplated tabular grain emulsions are those in which greater than 50 percent of the total projected area of the emulsion grains are accounted for by tabular grains having a thickness of less than 0.3 micrometer (0.5 micrometer for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al. U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. Nos. 5,310,635; 5,320,938; and 5,356,764.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, 5,147,772, 5,147,773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color-developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41™ process as described in The British Journal of Photography Annual of 1988, pages 191–198. If a color negative film element is to be subsequently employed to generate a viewable projection print as for a motion picture, a process such as the Kodak ECN-2™ process described in the H-24 Manual available from Eastman Kodak Co. may be employed to provide the color negative image on a transparent support. Color negative development times are typically 3 minutes 15 seconds. The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6™ process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color-developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(2-methanesulfonamidoethyl) aniline sesquisulfate hydrate,
4-amino-3-methyl-N-ethyl-N-(2-hydroxyethyl)aniline sulfate,
4-amino-3-(2-methanesulfonamidoethyl)-N,N-diethylaniline hydrochloride, and
4-amino-N-ethyl-N-(2-methoxyethyl)-m-toluidine di-p-toluene sulfonic acid.

Of the above, developers based on 4-amino-3-methyl-N-ethyl-N-(2-hydroxyethyl)aniline and 4-amino-3-methyl-N-ethyl-N-(2-methanesulfonamidoethyl)aniline are especially preferred. Moreover, because the compounds of the invention give increased light sensitivity, they are especially useful in processes that have shortened development times. In particular, the film elements of the invention can be processed with development times of less than 3.25 minutes or even less than 3 minutes or in extreme cases, even less than 120 seconds.

Development is usually followed by the conventional steps of bleaching, fixing, or bleach-fixing, to remove silver or silver halide, washing, and drying.

The entire contents of the patents and other publications referred to in this specification are incorporated herein by reference.

SYNTHESIS EXAMPLE

Preparation of 3-(vinylbenzyloxy)-1-propanol (Mixture of Meta and Para Isomers)

Potassium tert-butoxide (23.07 g, 0.206 mol) was added to a stirred solution of 1,3-propanediol (44.92 g, 0.591 mol) in dry tetrahydrofuran (400 ml) under an atmosphere of nitrogen. The reaction mixture was stirred for 15 min then a solution of vinylbenzylchloride (mixture of meta and para isomers) (30.00 g, 0.197 mol) in dry tetrahydrofuran (100 ml) was added dropwise over 30 min. The reaction was heated at reflux overnight then the tetrahydrofuran was removed in vacuo and the residue taken-up in water (400 ml) and diethyl ether (400 ml). The organic phase was washed with water, dried (magnesium sulfate) and concentrated in vacuo to give a liquid. The liquid was purified by column chromatography over silica gel (eluent 3:1:petrol ether/ethyl acetate, then ethyl acetate) to give the title compound (30.59 g, 0.159 mol, 81%) as a straw colored liquid.

5 Preparation of 6-(3-(vinylbenzyloxy)-1-propyloxy)purine (Mixture of Meta and Para Isomers)

Potassium tert-butoxide (35.64 g, 0.317 mol) was added to a stirred solution of 3-(vinylbenzyloxy)-1-propanol (mixture of meta and para isomers) (30.51 g, 0.158 mol) in dry tetrahydrofuran (300 ml) under an atmosphere of nitrogen. After 15 min 6-chloropurine (24.55 g, 0.159 mol) was added, and, after stirring for 15 min at room temperature, the reaction mixture was heated at reflux overnight. The reaction mixture was allowed to cool and then the solvent was removed in vacuo. First water (600 ml) then concentrated hydrochloric acid (17 ml) were added to the residue and stirred for 15 min. The acidic mixture was neutralized with saturated sodium hydrogen carbonate solution. After stirring for 15 min the solid was removed by filtration from the neutral suspension and dried. The solid was extracted with hot tetrahydrofuran (400 ml) for 2 hr and then the undissolved material was removed by filtration whilst hot. The filtrate was concentrated in vacuo and the residue (40.5 g of a yellow solid) recrystallized from tetrahydrofuran. This gave the title compound (27.78 g, 89.6 mmol, 56%) as a yellow solid.

Preparation of Polymeric Heterocycle P-1 (MH-1:IM-12=50:50)

5 g of MH-1, 5 g of IM-12 (sodium styrene sulfonate), 0.2 of azobisisobutyronitrile (AIBN) and 40 g of dimethylformamide (DMF) were mixed in a 120 ml vial , purged with nitrogen for 5 minutes and sealed. The vial was place in a tumbler and immersed in a constant temperature bath at 65° C. and polymerized for 24 hours. The white solid obtained was washed with large amount of acetone and filtered. The dry powder was dissolved in water. The % solid was 13.3%. The solution was slightly turbid.

Preparation of Polymeric Heterocycle P-2 (MH-1:IM-30 12=20:80)

5 g of MH-1, 20 g of IM-12 (sodium styrene sulfonate), 0.2 of 2,2'-AIBN and 75 g of DMF were mixed in a 120 ml vial, purged with nitrogen for 5 minutes and sealed. The vial was place in a tumbler and immersed in a constant temperature bath at 65° C. and polymerized for 24 hours. The white solid obtained was washed with a large amount of acetone and filtered. The dry powder was dissolved in water. The % solid was 11.6%. The solution was slightly turbid.

Preparation of Polymeric Heterocycle P-3 (MH-2:IM-12=50:50)

5 g of MH-2,5 g of IM-12 (sodium styrene sulfonate), 0.2 of AIBN and 40 g of DMF were mixed in a 1 20 ml vial, purged with nitrogen for 5 minutes and sealed. The vial was place in a tumbler and immersed in a constant temperature bath at 65° C. and polymerized for 24 hours. The white solid obtained was washed with a large amount of acetone and filtered. The dry powder was dissolved in water. The % solid was 13.2%. The solution was clear.

Preparation of Polymeric Heterocycle P-4 (MH-2:IM-12=20:80)

5 g of MH-2, 20 g of IM-12 (sodium styrene sulfonate), 0.2 of AIBN and 75 g of DMF were mixed in a 120 ml vial, purged with nitrogen for 5 minutes and sealed. The vial was place in a tumbler and immersed in a constant temperature bath at 65° C. and polymerized for 24 hours. The white solid obtained was washed with a large amount of acetone and filtered. The dry powder was dissolved in water. The % solid was 14.8%. The solution was clear.

Photographic Examples

Formulas for the identified compounds are provided at the end of all of the examples.

Format A (Addenda in Light-Sensitive Imaging Layer)

Monochrome films demonstrating the invention were produced by coating the following layers over a gelatin pad of 2.7 on a cellulose triacetate film support (all coverages are in grams per meter squared):

Layer 1 (Overcoat): gelatin at 2.7 and bis-(vinylsulfonyl) methylether hardener at 0.20.

Layer 2 (Fast Magenta Layer): gelatin at 2.7; M-1 at 0.084, DIR-7 at 0.003 and a green sensitized silver iodobromide emulsion at 1.296.

Layer 3 (Mid Magenta Layer): gelatin at 1.57; M-1 at 0.059; DIR-7 at 0.011, MC-2 at 0.108 and a green sensitized silver iodobromide emulsion at 0.972.

Layer 4 (Slow Magenta Layer): gelatin at 1.188; M-1 at 0.281; MC-2 at 0.0756 and a combination of two silver iodobromide emulsions at a total of 0.875.

Additional samples were prepared as above except the comparative or inventive test compounds were added directly to Layer 2 at the indicated levels in g/m$^2$ immediately before coating. These samples were given a stepwise exposure and processed in the KODAK FLEXICOLOR™ (C41) process as described in British Journal of Photography Annual, 1988, pp196–198 except that the temperature was 32.2° C. and the time of development was 2 minutes. Relative Speed or light sensitivity (ΔSpeed), given in terms of a fraction of a stop (1 stop is a doubling of light sensitivity), was determined by comparing the exposure point +0.15 density units above Dmin to the check position without addenda under the same conditions.

TABLE 1

Heterocyclic Polymers in Light-Sensitive Imaging Layers

| Sample | Comparative or Inventive | Addenda | Level | Δ Green Speed (Fresh vs. Check) |
|---|---|---|---|---|
| A-1 | Comp | — | — | (Check) |
| A-2 | Comp | DBL* | 0.0583 | +0.23 |
| A-3 | Comp | DBL* | 0.1138 | +0.32 |
| A-4 | Inv | P-1 | 0.0057 | +0.13 |
| A-5 | Inv | P-1 | 0.0569 | +0.39 |
| A-6 | Inv | P-1 | 0.0057 | +0.27 |
| | | DBL* | 0.0114 | |
| A-7 | Inv | P-1 | 0.0569 | +0.61 |
| | | DBL* | 0.1138 | |
| A-8 | Inv | P-2 | 0.0142 | +0.11 |
| A-9 | Inv | P-2 | 0.1423 | +0.20 |
| A-10 | Inv | P-3 | 0.0501 | +0.25 |
| A-11 | Inv | P-4 | 0.1254 | +0.19 |

*DBL = N,N-Dibutyllauramide added as a separate dispersion

Compare the speed results for Samples A-1 with those for A-4, A-5, and A-8 to A-11. The speed increases range form 0.11 to 0.39 stops. Similarly, compare A-3 with A-7 which shows that the improvement imparted by the addition of the DBL solvent is further increased by the addition of the polymer useful in the invention. The results shown in Table 1 clearly show that the inventive heterocyclic polymers improve the light sensitivity of an imaging layer. Moreover, it is not necessary to add additional permanent solvent in order to introduce the polymer into the film and still be effective.

Format B (Addenda in Light-Sensitive Imaging Layer)

Single layer films demonstrating the invention were produced by coating the following layers over a gelatin pad of 4.9 on a cellulose triacetate film support with RemJet backing:

Layer 1 (Overcoat): gelatin at 2.7 and bis-(vinylsulfonyl) methylether hardener at 0.20.

Layer 2 (Magenta Layer): gelatin at 2.7; M-1 at 0.43, DIR-7 at 0.0022, DIR-8 at 0.0108, O×DS-1 at 0.0025 and a green sensitized silver iodobromide emulsion at 1.296.

Additional samples were prepared as above except the comparative or inventive test compounds were added to Layer 2 at 0.081 mmol/m$^2$ and either coated immediately or stirred together for 30 or 60 minutes at 40° C. before coating, as would occur during a "manufacturing hold". Comp H-1 was dispersed in twice its own weight of N,N-dibutyllauramide. The process was as described previously. In this format, Δ Green Speed refers to change in speed (as defined previously) after stirring relative to the same sample coated immediately.

TABLE 2

Heterocyclic Polymers in Imaging Layers

| Sample | Comparative or Inventive | Addenda | Δ Green Speed vs. Fresh (>30 min) | Δ Green Speed vs. Fresh (>60 min) |
|---|---|---|---|---|
| B-1 | Comp | — | −0.103 | −0.060 |
| B-2 | Comp | Comp H-1 | −3.56 | −4.60 |
| B-3 | Comp | DBL* | +0.103 | +0.197 |
| B-4 | Inv | P-1 | −0.373 | −0.383 |
| B-5 | Inv | P-2 | −1.06 | −0.990 |
| B-6 | Inv | P-3 | −0.930 | −0.943 |
| B-7 | Inv | P-4 | −1.22 | −1.28 |

*DBL = N,N-Dibutyllauramide added as a separate dispersion at 0.058 $g/m^2$

The results shown in Table 2 clearly show that the inventive heterocyclic polymer causes significantly less undesirable speed loss when held together with the silver halide emulsion during a "manufacturing hold" when compared to a similar non-polymeric heterocycle of sufficient ClogP to increase fresh speed.

Format C (Addenda in Non-imaging Layer)

Bichrome films demonstrating the invention were produced by coating the following layers over a gel pad of 2.44 with 0.34 black collodial silver on a cellulose triacetate film support:

Layer 1 (Overcoat): gelatin at 2.7 and bis-(vinylsulfonyl) methylether hardener at 0.20.

Layer 2 (Yellow Layer): gelatin at 2.7; yellow coupler Y-1 at 0.972; DIR-3 at 0.054; and a combination of two blue sensitized silver iodobromide emulsions at a total of 0.70.

Layer 3 (Interlayer): gelatin at 0.648; ILS-1 at 0.0864; and YFL-1 at 0.108.

Layer 4 (Magenta Layer): gelatin at 2.7; magenta coupler M-1 at 0.449, DIR-7 at 0.003 and a green sensitized silver iodobromide emulsion at 0.702.

Additional samples were prepared as above except the comparative or inventive samples were added to Layer 3 at 0.018 mmoles/$m^2$ (based on the heterocycle). The comparative monomeric species were dispersed in twice their own weight of N,N-dibutyllauramide and the inventive polymers were added directly. These samples were given a stepwise exposure of each individual color using the appropriate Wratten filter and processed in the KODAK FLEXICOLOR™ (C-41) process. Speed of the appropriate color record was determined as above.

TABLE 3

Heterocyclic Polymers in Non-Imaging Layers

| Sample | Comparison or Invention | Addenda in Layer 3 | Blue Dmin | Δ Blue Fresh Speed vs. Check | Green Dmin | Δ Green Fresh Speed vs. Check |
|---|---|---|---|---|---|---|
| C-1 | Comp | None | 0.145 | (Check) | 0.656 | (Check) |
| C-2 | Comp | MH-1 | 0.106 | +0.03 | 0.157 | −0.83 |
| C-3 | Comp | MH-2 | 0.106 | −0.30 | 0.169 | −0.93 |
| C-4 | Inv | P-1 | 0.213 | +0.40 | 0.643 | +0.07 |
| C-5 | Inv | P-2 | 0.213 | +0.43 | 0.627 | +0.10 |
| C-6 | Inv | P-3 | 0.221 | +0.43 | 0.650 | +0.10 |
| C-7 | Inv | P-4 | 0.218 | +0.40 | 0.632 | +0.07 |

Comparing Check C-1 with C-2 and C-3 which employ non-polymeric compounds, it is observed that the Dmin is reduced but so is the speed. On the other hand, the Inventive samples impart improved speed in both the blue and green records with an improvement in green Dmin. The results in Table 3 demonstrate that the polymeric heterocycles of the invention are effective at improving the speed of adjacent imaging layers when coated in a non-silver containing light-insensitive layer compared to the corresponding monomeric heterocycles.

Format D (Multilayer)

Multilayer films demonstrating the principles of this invention were produced by coating the following layers on a cellulose triacetate film support (coverage are in grams per meter squared, emulsion sizes as determined by the disc centrifuge method and are reported in Diameter×Thickness in micrometers). Surfactants, coating aids, emulsion addenda, sequestrants, thickeners, lubricants, matte and tinting dyes were added to the appropriate layers as is common in the art.

Layer 1 (Antihalation layer): gelatin at 1.62, colloidal gray silver at 0.151; DYE-1 at 0.013; DYE-3 at 0.108; DYE4 at 0.037; and UV-1 and UV-2 each at 0.076.

Layer 2 (Interlayer): gelatin at 0.54 and ILS-1 at 0.076.

Layer 3 (Slow cyan layer): a blend of two red sensitized (all with a mixture of RSD-1 and RSD-3) silver iodobromide emulsions: (i) a large sized iodobromide tabular grain emulsion (1.25×0.124, 4.1 mol % I) at 0.313, (ii) a smaller iodobromide tabular emulsion (0.74×0.12, 4.1 mol % I) at 0.266; cyan dye-forming coupler C-1 at 0.228; C-2 at 0.364; bleach accelerator releasing coupler B-1 at 0.081; masking coupler MC-1 at 0.032 and gelatin at 1.67.

Layer 4 (Mid cyan layer): a red sensitized (all with a mixture of RSD-1 and RSD-3) iodobromide tabular emulsion (2.25×0.125, 3.1 mol % I) at 1.177; C-2 at 0.21 1; DIR-5 at 0.01 1; DIR-6 at 0.01 1; ILS-1 at 0.011 and gelatin at 1.62.

Layer 5 (Fast cyan layer): a red sensitized (with a mixture of RSD-1 and RSD-3) iodobromide tabular emulsion (4.05×0.13, 3.7 mol % I) at 1.295; C-2 at 0.227; DIR-5 at 0.0.022; DIR-6 at 0.025; ILS-1 at 0.014 and gelatin at 1.49.

Layer 6 (Interlayer): ILS-1 at 0.076 and gelatin at 0.54.

Layer 7 (Slow magenta layer): a blend of two green sensitized (both with a mixture of GSD-1 and GSD-2) silver iodobromide tabular emulsions: (i) 0.88×0.12, 4.1 mol % iodide at 0.539 and (ii) 1.2×0.12, 4.1 mol % iodide at 0.336; magenta dye forming coupler M-1 at 0302; masking coupler MC-2 at 0.076 and gelatin at 1.188.

Layer 8 (Mid magenta layer): a green sensitized (with a mixture of GSD-1 and GSD-2) silver iodobromide tabular emulsion: (2.85×0.116, 3.6 mol % iodide) at 0.972; M-1 at 0.103; MC-2 at 0.086; DIR-7 at 0.011 and gelatin at 1.566.

Layer 9 (Fast magenta layer): a green sensitized (with a mixture of GSD-1 and GSD-2) silver iodobromide tabular emulsion (3.95×0.14, 3.6 mol % iodide) at 1.296; M-1 at 0.084; DIR-7 at 0.003 and gelatin at 1.62.

Layer 10 (Yellow filter layer): ILS-1 at 0.076; YFD-1 at 0.108 and gelatin at 0.81.

Layer 11 (Slow yellow layer): a blend of three blue sensitized (all with BSD-1) tabular silver iodobromide emulsions (i) 0.54×0.086, 1.3 mol % I at 0.395, (ii) 0.96×0.26, 6 mol % I at 0.233, (iii) 1.03×0.13, 1.5 mol % I at 0.081; yellow dye forming coupler Y-1 at 0.735; DIR-3 at 0.027; B-1 at 0.003 and gelatin at 1.62.

Layer 12 (Fast yellow layer): a blue sensitized (with BSD-1) tabular silver iodobromide emulsion ( 2.9×0.13, 4.1 mol % ID at 0.414 and a 3D silver iodobromide emulsion (1.4 diameter, 14 mol % I) at 0.905; Y-1 at 0.426; DIR-3 at 0.027; B-1 at 0.011 and gelatin at 1.706.

Layer 13 (Protective overcoat and UV filter layer): silver bromide Lippman emulsion at 0.216; UV-1 and UV-2 both at 0.108, gelatin at 1.242 and bis(vinylsulfonyl) methane hardener at 1.75% of total gelatin weight.

Additional samples were prepared as above except the comparative or inventive samples were added either to Layer 9 (the fastest magenta imaging layer) at 0.018 mmoles/$m^2$ (based on the heterocycle) or to Layer 10 (a non-silver containing non-imaging interlayer) at 0.036 mmoles/$m^2$. The comparative monomeric species were dispersed in twice their own weight of N,N-dibutyllauramide and the inventive polymers were added directly. These samples were given a stepwise neutral or green separation (using a Wratten WR74 filter) exposure and processed in the KODAK FLEXICOLOR™ (C-41) process. Speed of the appropriate color record was determined as above. Granularity of the green layer in a neutral exposure was determined by the RMS method (see *The Theory of the Photographic Process,* 4th Edition, T. H. James, pp 625–628) using a 48 micrometer aperture at the density 1.2 log exposure units from the speed point defined above.

TABLE 4

Multilayer Results with Polymeric Heterocycles in Imaging Layers

| Sample | Comp/Inv | Addenda in Layer 9 | Green Speed of Neutral | Green Speed of Green Only | Granularity ($x10^3$) |
|---|---|---|---|---|---|
| D-1 | Comp | None | (Check) | (Check) | 17.32 |
| D-2 | " | MH-1 | −0.20 | −0.33 | 14.49 |
| D-3 | " | MH-2 | −0.33 | −0.27 | (*) |
| D-4 | Inv | P−1 | +0.23 | +0.30 | 16.37 |
| D-5 | " | P-2 | +0.17 | +0.33 | 15.78 |
| D-6 | " | P-3 | +0.13 | +0.27 | 16.40 |
| D-7 | " | P-4 | +0.10 | +0.20 | 15.99 |

TABLE 4-continued

Multilayer Results with Polymeric Heterocycles in Imaging Layers

| Sample | Comp/Inv | Addenda in Layer 9 | Green Speed of Neutral | Green Speed of Green Only | Granularity ($x10^3$) |
|---|---|---|---|---|---|

*Data not available

TABLE 5

Multilayer Results with Polymeric Heterocycles in Non-Imaging Layers

| Sample | Comp/Inv | Addenda in Layer 10 | Green Speed of Neutral | Green Speed of Green Only | Granularity ($x10^3$) |
|---|---|---|---|---|---|
| D-1 | Comp | None | (Check) | (Check) | 17.32 |
| D-9 | " | MH-1 | −0.90 | −1.10 | 18.91 |
| D-10 | " | MH-2 | −0.83 | −1.00 | (*) |
| D-11 | Inv | P-1 | +0.20 | +0.37 | 16.13 |
| D-12 | " | P-2 | +0.17 | +0.33 | 16.22 |
| D-13 | " | P-3 | +0.17 | +0.30 | 16.57 |
| D-14 | " | P-4 | +0.17 | +0.37 | 16.02 |

*Data not available

As demonstrated by the data in Tables 4 and 5, the polymeric compounds of the invention give enhanced photographic response to light and low granularity compared to the check. The comparative low ClogP monomers do not accomplish this result.

Formulas for materials used in the above formats are as follows:

B-1

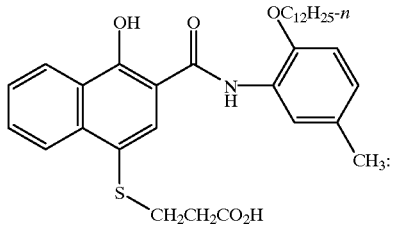

BSD-1

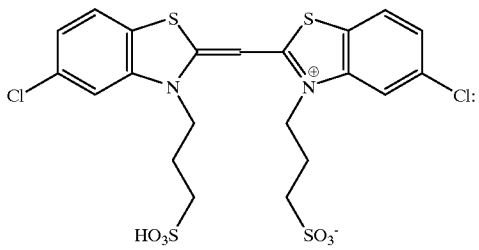

C-1

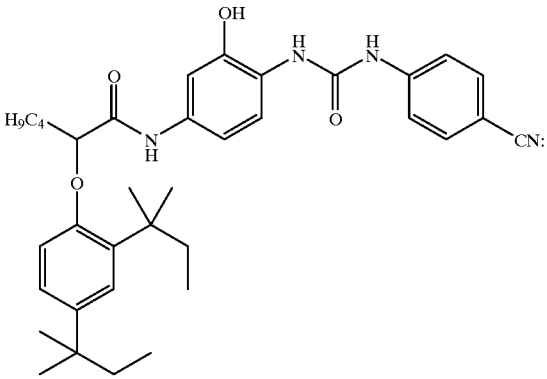

C-2

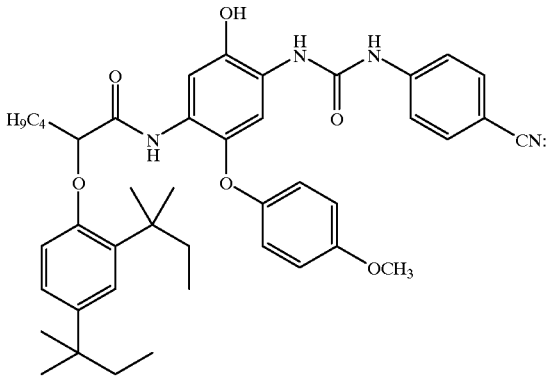

-continued
DIR-3
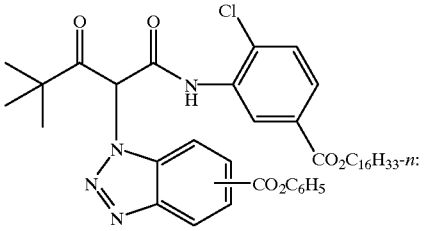
DIR-5
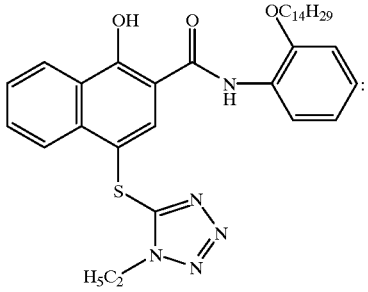
DIR-6
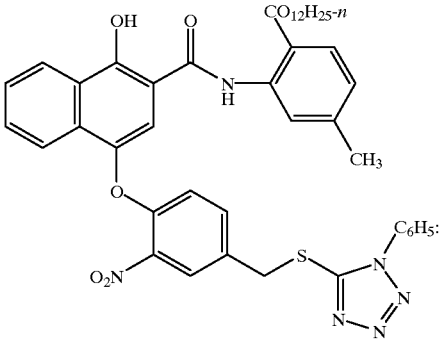
DIR-7
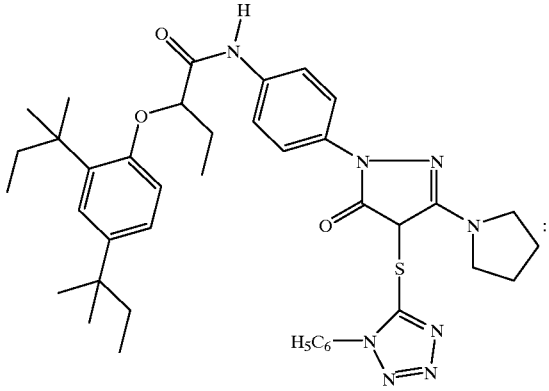
DIR-8
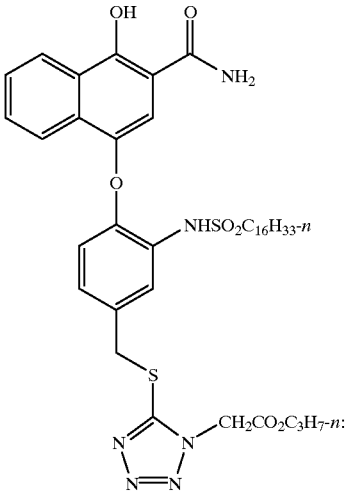

-continued
DYE-1
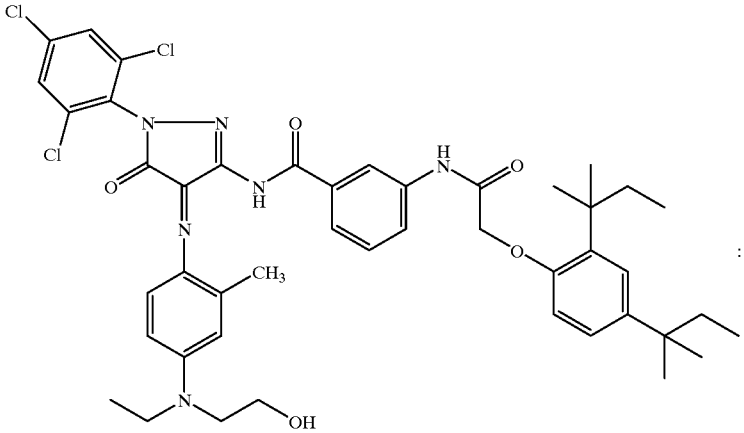
:
DYE-3
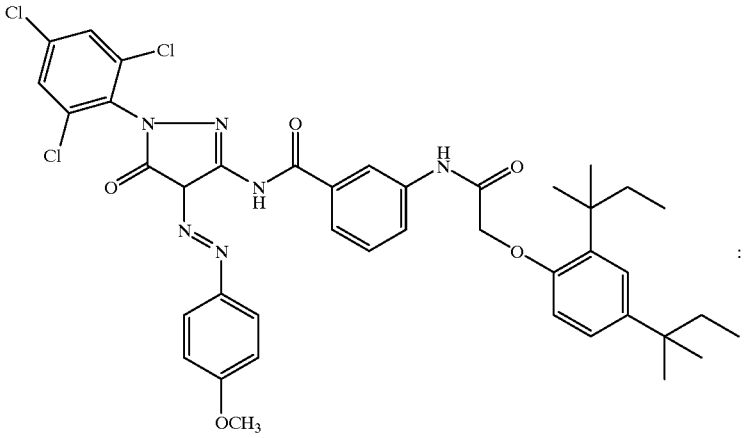
:
DYE-4
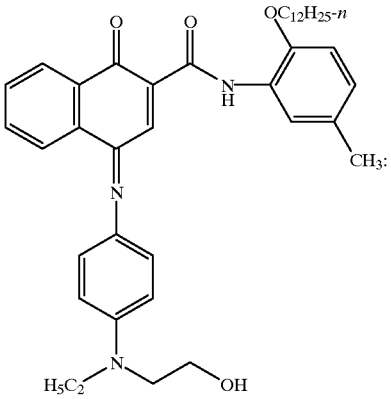
ILS-1
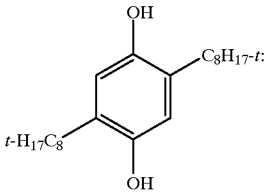

-continued
MC-1
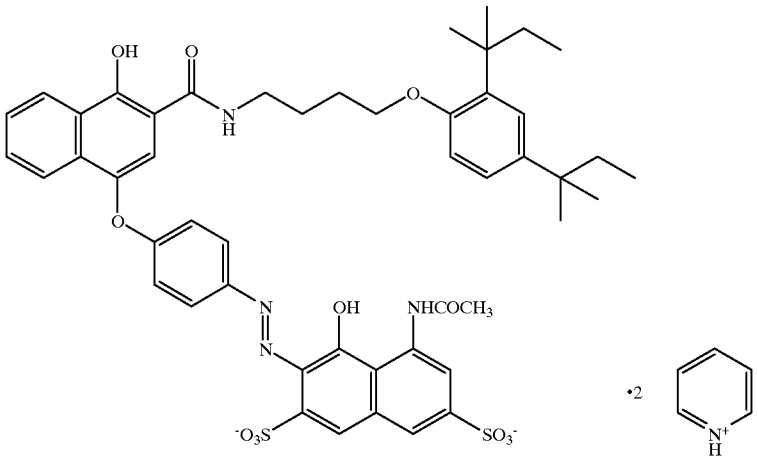
MC-2
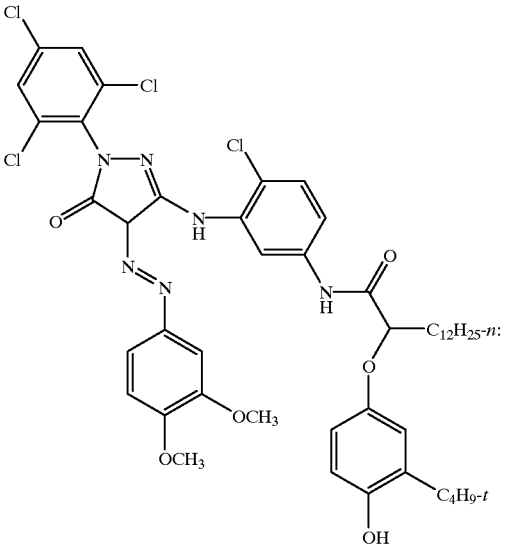
OxDS-1
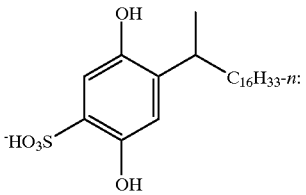
RSD-1
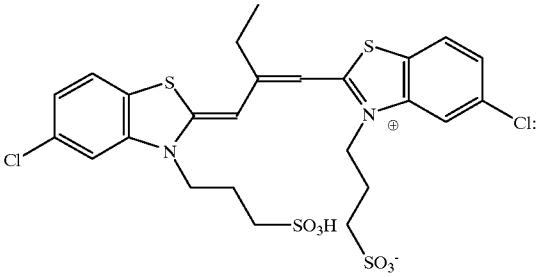
RSD-3
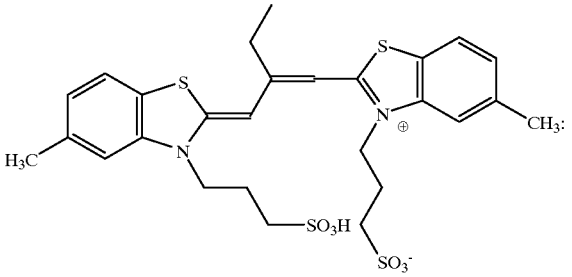

-continued

Y-1

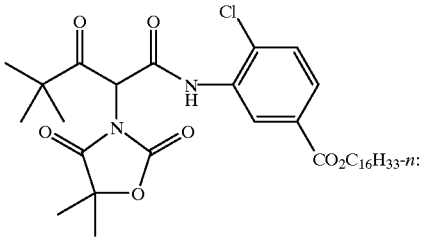

YFD-1

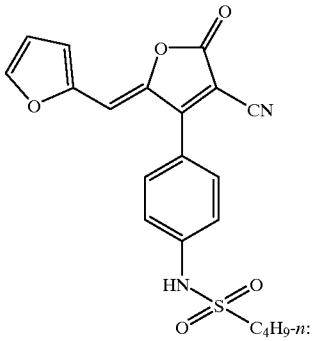

UV-1

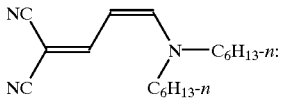

UV-2

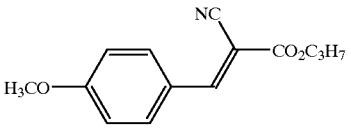

Comp H-1

(ClogP = 7.84)

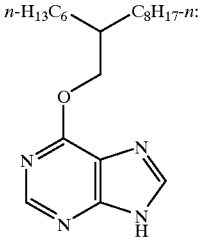

The invention has been described in detail with particular reference to preferred embodiments thereof, but it will be understood that variations and modifications can be effected within the scope and spirit of the invention.

What is claimed is:

1. A color silver halide photographic element comprising a light-sensitive silver halide emulsion layer or a non-silver containing light-insensitive layer, said light-sensitive or light-insensitive layer containing a polymer compound comprising a heterocycle unit derived from:

(a) a heterocycle monomer (1) comprising two or more annulated rings containing, in total, a minimum of three ring heteroatoms of which no more than two of the heteroatoms are connected in sequence to each other and (2) having a ClogP less than 6.2; or (b) a monocyclic heterocycle monomer having exactly three ring heteroatoms and having a ClogP less than 8.75;

with the proviso that the heterocycle unit does not contain a hydroxy or mercapto group (or their tautomeric equivalent), and does not react with oxidized developer; and the amount of the polymer compound in the element being sufficient to increase the photographic speed of the element compared to the same element without the compound.

2. The color photographic element of claim 1 wherein the polymer compound is present in a light-sensitive silver halide emulsion layer.

3. The color photographic element of claim 2 wherein the ratio of the number of millimoles of the heterocycle unit in the polymer to the number of mols of silver in the same layer is at least 1.0.

4. The color photographic element of claim 2 wherein the light-sensitive layer is the most sensitive layer of two or more layers having the same spectral sensitivity.

5. The color photographic element of claim 1 wherein the polymer compound is present in a non-silver containing light-insensitive layer.

6. The color photographic element of claim 5 wherein the light-insensitive layer is adjacent to a light-sensitive layer.

7. The color photographic element of claim 6 wherein the light-sensitive layer is the most light-sensitive of two or more light-sensitive layers of the same spectral sensitivity.

8. The color photographic element of claim 1 wherein the heterocycle unit is derived form a heterocycle monomer (1) comprising two or more annulated rings containing, in total, a minimum of three ring heteroatoms of which no more than two of the heteroatoms are connected in sequence to each other and (2) having a monomer ClogP less than 6.2.

9. The color photographic element of claim 8 wherein the heterocycle unit contains at least three nitrogen atoms.

10. The color photographic element of claim 1 in which the silver halide layer comprises silver iodobromide.

11. The color photographic element of claim 10 in which the silver halide has maximum spectral sensitivity to light with wavelength between 500 and 600 nm.

12. The color photographic element of claim 1 wherein the polymer compound comprises a 1,3,4,6-tetraazaindene heterocycle unit with a monomer ClogP less than 6.2.

13. The color photographic element of claim 12 wherein the 1,3,4,6-tetraazaindene heterocycle unit is represented by the Formula I:

I

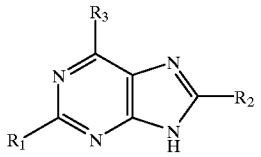

wherein $R_1$ and $R_2$ are each independently hydrogen or an alkyl, aryl, alkoxy or aryloxy, alkylthio or arylthio, sulfoxyl, sulfonyl, sulfamoyl, fluoro, chloro, bromo, iodo, cyano, nitro, —O—CO—, —O—$SO_2$—, heterocyclic, carbonyl, amino, carbonamido, or sulfonamido group and $R_3$ is an alkyl, aryl, alkoxy, aryloxy, alkylthio, arylthio, secondary or tertiary amino, carbonamido, sulfonyl or a sulfonamido group and where at least one of $R_1$, $R_2$ or $R_3$ provides a covalent link to a polymer backbone.

14. The color photographic element of claim 13 wherein $R_3$ is an alkoxy or alkylthio group.

15. The color photographic element of claim 13 wherein the ratio of the number of millimoles of the nitrogen heterocycle unit in the polymer to the number of mols of silver in the same layer is at least 1.0.

16. The color photographic element of claim 1 wherein the polymer comprises a 1,2,5,7-tetraazaindene or a 1,2,4,6-tetraazaindene heterocycle unit where the corresponding monomer ClogP is less than 6.2.

17. The color photographic element of claim 16 wherein the 1,2,5,7-tetraazaindene heterocycle unit is represented by the Formula IIa:

IIa

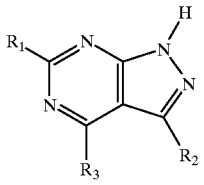

wherein $R_1$ and $R_2$ are each independently hydrogen or an alkyl, aryl, alkoxy or aryloxy, alkylthio or arylthio, sulfoxyl, sulfonyl, sulfamoyl, fluoro, chloro, bromo, iodo, cyano, nitro, —O—CO—, —O—$SO_2$—, heterocyclic, carbonyl, amino, carbonamido, or sulfonamido group and $R_3$ is an alkyl, aryl, alkoxy, aryloxy, alkylthio, arylthio, secondary or tertiary amino, carbonamido, sulfonyl or a sulfonamido group and where at least one of $R_1$, $R_2$ or $R_3$ provides a covalent link to a polymer backbone.

18. The color photographic element of claim 17 wherein $R_3$ is an alkoxy or alkylthio group.

19. The color photographic element of claim 17 wherein the ratio of the number of millimoles of the nitrogen heterocycle unit in the polymer to the number of mols of silver in the same layer is at least 1.0.

20. The color photographic element of claim 16 wherein the 1,2,4,6-tetraazaindene heterocycle unit is represented by Formula IIb:

IIb

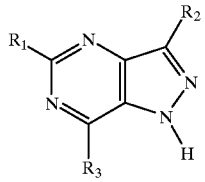

wherein $R_1$ and $R_2$ are each independently hydrogen or an alkyl, aryl, alkoxy or aryloxy, alkylthio or arylthio, sulfoxyl, sulfonyl, sulfamoyl, fluoro, chloro, bromo, iodo, cyano, nitro, —O—CO—, —O—$SO_2$—, heterocyclic, carbonyl, amino, carbonamido, or sulfonamido group and $R_3$ is an alkyl, aryl, alkoxy, aryloxy, alkylthio, arylthio, secondary or tertiary amino, carbonamido, sulfonyl or a sulfonamido group and where at least one of $R_1$, $R_2$ or $R_3$ provides a covalent link to a polymer backbone.

21. The color photographic element of claim 20 wherein $R_3$ is an alkoxy or alkylthio group.

22. The color photographic element of claim 20 wherein the ratio of the number of millimoles of the nitrogen heterocycle unit in the polymer compound to the number of mols of silver in the same layer is at least 1.0.

23. The color photographic element of claim 1 wherein the polymer compound comprises a 1,2,3a,7-tetraazindene heterocycle unit with a corresponding monomer ClogP of less than 6.2.

24. The color photographic element of claim 23 wherein the 1,2,3a,7-tetraazaindene heterocycle unit is represented by the Formula III:

III

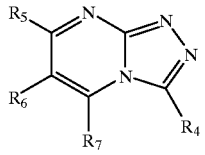

wherein $R_5$, $R_6$ and $R_7$ are each independently hydrogen or an alkyl, aryl, alkoxy or aryloxy, alkylthio or arylthio, sulfoxyl, sulfonyl, sulfamoyl, fluoro, chloro, bromo, iodo, cyano, nitro, —O—CO—, —O—$SO_2$—, heterocyclic, carbonyl, amino, carbonamido, or sulfonamido group and $R_4$ is an alkyl, aryl, alkoxy, aryloxy, alkylthio, arylthio, secondary or tertiary amino, carbonamido, sulfonyl or a sulfonamido group and where at least one of $R_4$, $R_5$, $R_6$ and $R_7$ provides a covalent link to a polymer backbone.

25. The color photographic element of claim 24 wherein $R_4$ is an alkoxy or alkylthio group.

26. The color photographic element of claim 24 wherein the ratio of the number of millimoles of the nitrogen heterocycle in the polymer compound to the number of mols of silver in the same layer is at least 1.0.

27. The color photographic element of claim 1 wherein the polymer compound comprises a 1,3,3a,7-tetraazaindene heterocycle unit having a corresponding monomer ClogP of less than 6.2.

28. The color photographic element of claim 27 wherein the 1,3,3a,7-tetraazaindene heterocycle unit is represented by the Formula IV:

IV

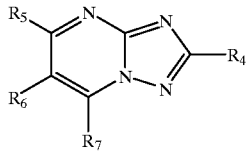

wherein $R_4$, $R_5$, $R_6$ and $R_7$ are each independently hydrogen or an alkyl, aryl, alkoxy or aryloxy, alkylthio or arylthio, sulfoxyl, sulfonyl, sulfamoyl, fluoro, chloro, bromo, iodo, cyano, nitro, —O—CO—, —O—$SO_2$—, heterocyclic, carbonyl, amino, carbonamido, or sulfonamido group and $R_4$ is an alkyl, aryl, alkoxy, aryloxy, alkylthio, arylthio, secondary or tertiary amino, carbonamido, sulfonyl or a sulfonamido group and where at least one of $R_4$, $R_5$, $R_6$ and $R_7$ provides a covalent link to a polymer backbone.

29. The color photographic element of claim 25 wherein $R_4$ is an alkoxy or alkylthio group.

30. The color photographic element of claim 25 wherein the ratio of the number of millimoles of the nitrogen heterocycle in the polymer to the number of mols of silver in the same layer is at least 1.0.

31. The color photographic element of claim 1 wherein the polymer compound comprises a triazole heterocycle unit with a corresponding monomer ClogP equal to or greater than zero and less than 8.75.

32. The color photographic element of claim 31 wherein the triazole heterocycle unit is a 1,2,4-triazole represented by Formula V:

V

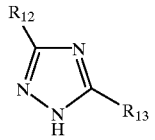

where $R_{12}$ is hydrogen, alkyl or aryl and $R_{13}$ is a alkylthio or arylthio, carboxylate ester or substituted alkyl group and where at least one of $R_{13}$ or $R_{14}$ provides a covalent link to a polymer backbone.

33. The color photographic element of claim 31 wherein the triazole heterocycle unit is a 1,2,3-triazole represented by Formula VI:

VI

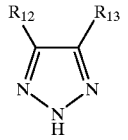

where $R_{12}$ is hydrogen, alkyl or aryl and $R_{13}$ is a alkylthio or arylthio, carboxylate ester or substituted alkyl group and where at least one of $R_{13}$ or $R_{14}$ provides a covalent link to a polymer backbone.

34. The color photographic element of claim 31 wherein the ratio of the number of millimoles of the nitrogen heterocycle in the polymer compound to the number of mols of silver in the same layer is at least 1.0.

35. The color photographic element of claim 1 wherein the polymer compound comprises a heterocycle unit selected from an oxa- or thiadiazole with a corresponding monomer ClogP of less than 7.6 and equal to or greater than zero.

36. The color photographic element of claim 35 wherein the heterocycle unit is an oxadiazole represented by Formula VII:

VII

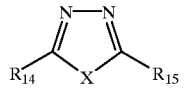

where X is oxygen; $R_{14}$ is an alkylthio or arylthio group and $R_{15}$ is an alkyl, aryl, alkylthio, arylthio or amino group and where at least one of $R_{14}$ or $R_{15}$ provides a covalent link to a polymer backbone.

37. The color photographic element of claim 35 wherein the heterocycle unit is a thiadiazole represented by Formula VII:

VII

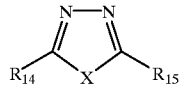

where X is sulfur; $R_{14}$ is an alkylthio or arylthio group and $R_{15}$ is an alkyl, aryl, alkylthio, arylthio or amino group and where at least one of $R_{14}$ or $R_{15}$ provides a covalent link to a polymer backbone.

38. The color photographic element of claim 35 wherein the ratio of the number of millimoles of the nitrogen heterocycle unit to the number of mols of silver in the same layer is at least 1.0.

39. The color photographic element of claim 1 wherein the layer that contains the polymeric heterocycle also contains an organic solvent that has a ClogP of 5.0 or greater and a beta of 0.4 or more.

40. The element of claim 11 wherein the layer containing the polymer compound additionally contains a pyrazolone or azole coupler.

41. The element of claim 1 wherein the element is an origination or image-capture material for capturing an original image.

42. The color photographic element of claim 5 in which the polymer is present at a laydown of $3.0\times10^{-5}$ mol/$m^2$ (based on the heterocycle unit) or greater.

43. The color photographic element of claim 5 in which the non-silver containing light-insensitive layer additionally contains a scavenger for oxidized developer.

44. The color photographic element of claim 4 wherein the mole ratio of the dye-forming coupler(s) to the silver present in the layer is less than 0.5.

45. The element of claim 44 wherein the mole ratio is less than 0.2.

46. The color photographic element of claim 1 wherein the polymer compound additionally contains an ionizable second unit derived from a monomer according to Formula (B):

(B)

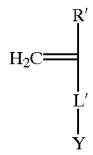

wherein R' is a hydrogen, alkyl or aryl group; L' is a linking group chosen from the group of —O—, —S—, —NH—, —$CH_2$— or —$SO_2$—; and Y is an ionizable sub-unit chosen from the group consisting of sulfonates, sulfates, phosphates, carboxylates, thiosulfates and sulfinates.

47. The color photographic element of claim 12 where the polymer compound additionally contains an ionizable unit derived from a monomer according to Formula (B):

(B)

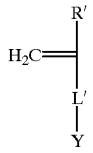

wherein R' is a hydrogen, alkyl or aryl group; L' is a linking group chosen from the group of —O—, —S—, —NH—, —$CH_2$— or —$SO_2$—; and Y is a ionizable sub-unit chosen from the group of sulfonates, sulfates, phosphates, carboxylates, thiosulfates and sulfinates.

48. The color photographic element of claim 46 in which the polymer compound contains from 20 to 80 weight percent of the ionizable unit.

49. A color photographic element as in claim 1 that contains a polymer compound with repeating units according to Formula A:

(A)

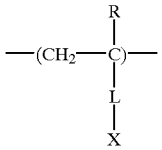

wherein,

R is hydrogen or an alkyl or aryl group;

L is a linking group; and

X is a heterocycle unit comprising two or more annulated ring containing, in total, a minimum of three ring heteroatoms of which no more than two of the heteroatoms arc connected in sequence to each other so that the monomer corresponding to (A) has a ClogP less than 6.2.

50. The color photographic element of claim 49 where R is hydrogen or methyl group and L is chosen from the groups:

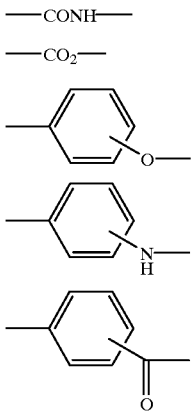

-continued

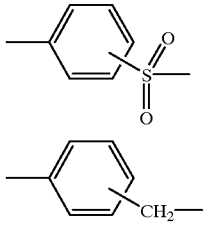

51. The color photographic element of claim 49 in which the polymer compound additionally contains from 20 to 80 weight percent of an ionizable unit derived from a monomer according to Formula (B):

(B)

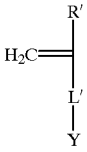

wherein R' is a hydrogen, alkyl or aryl; L' is a divalent linking group chosen from the group of —O—, —S—, —NH—, —$CH_2$— or —$SO_2$—; and Y is a ionizable subunit chosen from the group of sulfonates, sulfates, phosphates, carboxylates, thiosulfates and sulfinates.

52. The color photographic element as in claim 1 that contains a polymer with repeating units according to formula A:

(A)

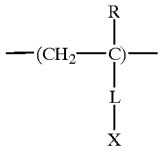

wherein R is hydrogen or an alkyl or aryl group; L is a divalent linking group; and X is a monocyclic heterocycle which contains exactly three heteroatoms, is not substituted with a hydroxyl or thiol group, so that the corresponding monomer to (A) has a ClogP of less than 8.75 and equal to or greater than 0.0.

53. The color photographic element of claim 52 where R is hydrogen or methyl group and L is chosen from the groups:

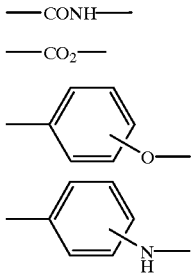

-continued

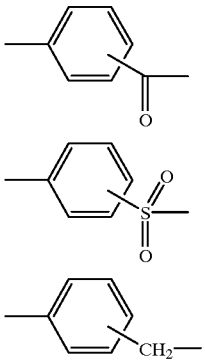

54. The color photographic element of claim 52 in which the polymer additionally contains from 20 to 80 weight percent of an ionizable unit derived from a monomer according to Formula (B):

(B)

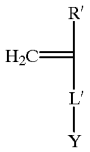

wherein R' is a hydrogen, all or aryl; L' is a divalent linking group chosen from the group of —O—, —S—, —NH—, —$CH_2$— or —$SO_2$—; and Y is a ionizable subunit chosen from the group of sulfonates, sulfates, phosphates, carboxylates, thiosulfates and sulfinates.

55. A process for forming a photographic image, comprising contacting with a p-phenylenediamine color developer the photographic element as described in claim 1.

56. The process of claim 55 wherein the color developer comprises 2-[(4-amino-3-methylphenyl)ethylamino]ethanol or 4-amino-3-methyl-N-ethyl-N-(2-methanesulfonamidoethyl)aniline.

57. A color silver halide photographic element comprising a light-sensitive silver halide emulsion layer or a non-silver containing light-insensitive layer, said light-sensitive or light-insensitive layer containing a polymer compound comprising a heterocycle unit derived from:

(a) a heterocycle monomer (1) comprising two or more annulated rings containing, in total, a minimum of three ring heteroatoms of which no more than two of the heteroatoms are connected in sequence to each other and (2) having a ClogP less than 6.2; or (b) a monocyclic heterocycle monomer having exactly three ring heteroatoms and having a ClogP less than 8.75;

with the proviso that the heterocycle unit does not contain a hydroxy or mercapto group (or their tautomeric equivalent), and does not react with oxidized developer; and the further proviso that the solubility of the polymer compound in water is from 0.25 to 50% by weight; and the amount of the polymer compound in the element being sufficient to increase the photographic speed of the element compared to the same element without the compound.

58. A color silver halide photographic element comprising a light-sensitive silver halide emulsion layer or a non-silver containing light-insensitive layer, said light-sensitive or light-insensitive layer containing a polymer compound comprising a heterocycle unit derived from:

(a) a heterocycle monomer (1) comprising two or more annulated rings containing, in total, a minimum of three ring heteroatoms of which no more than two of the heteroatoms are connected in sequence to each other and (2) having a ClogP less than 6.2; or (b) a monocyclic heterocycle monomer having exactly three ring heteroatoms and having a ClogP less than 8.75;

with the proviso that the heterocycle unit does not contain a hydroxy or mercapto group (or their tautomeric equivalent), and does not react with oxidized developer; and the further proviso that the polymer compound further comprises a co-monomer containing an ionizable group; and the amount of the polymer compound in the element being sufficient to increase the photographic speed of the element compared to the same element without the compound.

59. A color silver halide photographic element comprising a light-sensitive silver halide emulsion layer or a non-silver containing light-insensitive layer, said light-sensitive or light-insensitive layer containing a polymer compound comprising a heterocycle unit derived from:

(a) a heterocycle monomer (1) comprising two or more annulated rings containing, in total, a minimum of three ring heteroatoms of which no more than two of the heteroatoms are connected in sequence to each other and (2) having a ClogP less than 6.2; or (b) a monocyclic heterocycle monomer having exactly three ring heteroatoms and having a ClogP less than 8.75;

with the proviso that the heterocycle unit does not contain a hydroxy or mercapto group (or their tautomeric equivalent), and does not react with oxidized developer; and the further proviso that the polymer compound further comprises a co-monomer that is a vinylogous acid or salt; and the amount of the polymer compound in the element being sufficient to increase the photographic speed of the element compared to the same element without the compound.

* * * * *